US008143177B2

(12) United States Patent
Noda et al.

(10) Patent No.: US 8,143,177 B2
(45) Date of Patent: Mar. 27, 2012

(54) NONWOVEN FABRIC

(75) Inventors: Yuki Noda, Kagawa (JP); Hideyuki Ishikawa, Kagawa (JP); Satoshi Mizutani, Kagawa (JP); Akihiro Kimura, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 1215 days.

(21) Appl. No.: 11/748,186

(22) Filed: May 14, 2007

(65) Prior Publication Data

US 2007/0298671 A1 Dec. 27, 2007

(30) Foreign Application Priority Data

Jun. 23, 2006 (JP) ..... 2006-174505
Sep. 29, 2006 (JP) ..... 2006-270106

(51) Int. Cl.
*D04H 3/10* (2006.01)

(52) U.S. Cl. ..... 442/408; 428/218; 428/219; 428/220
(58) Field of Classification Search ..... 442/408
See application file for complete search history.

(56) References Cited

U.S. PATENT DOCUMENTS 3,458,905 A 8/1969 Dodson, Jr. et al.
3,485,706 A 12/1969 Evans
3,486,168 A 12/1969 Evans et al.
3,766,922 A 10/1973 Krusko
4,016,317 A 4/1977 Kalwaites
4,016,319 A 4/1977 Marshall
4,038,452 A 7/1977 Kobayashi et al.
4,186,463 A 2/1980 Marshall
4,190,695 A 2/1980 Niederhauser
4,379,799 A 4/1983 Holmes et al.
4,582,666 A 4/1986 Kenworthy et al.
4,612,226 A 9/1986 Kennette et al.
4,695,500 A 9/1987 Dyer et al.
4,735,842 A 4/1988 Buyofsky et al.
4,787,947 A 11/1988 Mays
4,835,042 A 5/1989 Dohzono et al.
4,840,829 A 6/1989 Suzuki et al.

(Continued)

FOREIGN PATENT DOCUMENTS

CN 1294904 5/2001

(Continued)

OTHER PUBLICATIONS

Office Action issued to U.S. Appl. No. 11/762,421, mailed Oct. 6, 2009.

(Continued)

*Primary Examiner* — Lynda Salvatore
(74) *Attorney, Agent, or Firm* — Lowe, Hauptman, Ham & Berner, LLP

(57) ABSTRACT

It is an objective of the present invention to provide a nonwoven fabric prepared so as to be able to rapidly transfer a predefined liquid. The nonwoven fabric is formed by jetting a fluid, which consists mainly of gaseous matter, to a fiber web 100 supported from beneath by a predefined breathable support member, from an upper surface side in order to move fibers in the fiber web 100. A number of groove portions 1 and a number of convex portions 2 are formed on a jetted area of the nonwoven fabric in the direction in which the area is extended, and the fiber density of the groove portions 1 is less than the fiber density of the convex portions 2.

24 Claims, 21 Drawing Sheets

U.S. PATENT DOCUMENTS

| | | | | |
|---|---|---|---|---|
| 5,607,414 | A | 3/1997 | Richards et al. | |
| 5,613,962 | A | 3/1997 | Kenmochi et al. | |
| 5,618,610 | A | 4/1997 | Tomita et al. | |
| 5,733,625 | A | 3/1998 | Tsuchiya et al. | |
| 5,897,547 | A | 4/1999 | Schmitz | |
| 5,900,109 | A | 5/1999 | Sanders et al. | |
| 6,039,555 | A | 3/2000 | Tsuji et al. | |
| 6,096,016 | A * | 8/2000 | Tsuji et al. | 604/378 |
| 6,395,957 | B1 | 5/2002 | Chen et al. | |
| 6,451,718 | B1 | 9/2002 | Yamada et al. | |
| 6,582,798 | B2 | 6/2003 | Thomas | |
| 6,586,076 | B1 | 7/2003 | Mizutani et al. | |
| 6,610,173 | B1 | 8/2003 | Lindsay et al. | |
| 6,641,902 | B1 | 11/2003 | Kobayashi et al. | |
| 6,802,932 | B2 | 10/2004 | Kudo et al. | |
| 6,855,424 | B1 | 2/2005 | Thomas et al. | |
| 6,867,156 | B1 | 3/2005 | White et al. | |
| 6,936,333 | B2 | 8/2005 | Shizuno et al. | |
| 7,507,463 | B2 | 3/2009 | Noda et al. | |
| 7,553,535 | B2 | 6/2009 | Noda et al. | |
| 7,662,462 | B2 | 2/2010 | Noda et al. | |
| 2002/0010449 | A1 | 1/2002 | Mizutani | |
| 2003/0198784 | A1 | 10/2003 | Mizutani et al. | |
| 2003/0232558 | A1 | 12/2003 | Moody, III et al. | |
| 2005/0177121 | A1 | 8/2005 | Mizutani et al. | |
| 2008/0289157 | A1 | 11/2008 | Higashinaka et al. | |

FOREIGN PATENT DOCUMENTS

| | | | |
|---|---|---|---|
| DE | 4437165 | A1 | 4/1996 |
| DE | 102005036759 | A1 | 8/2006 |
| EP | 0703308 | | 3/1996 |
| EP | 0903136 | A2 | 3/1999 |
| EP | 0926287 | A1 | 6/1999 |
| EP | 1090615 | | 4/2001 |
| EP | 1201213 | A2 | 5/2002 |
| EP | 1269956 | | 1/2003 |
| JP | 02169718 | A | 6/1990 |
| JP | 02-229255 | A | 9/1990 |
| JP | 403137257 | * | 6/1991 |
| JP | 08-60509 | A | 3/1996 |
| JP | 2000-290863 | A | 10/2000 |
| JP | 2002-30557 | A | 1/2002 |
| JP | 2002-136547 | A | 5/2002 |
| JP | 2002243965 | | 8/2002 |
| JP | 2002-249965 | A | 9/2002 |
| JP | 2003126147 | | 5/2003 |
| JP | 3587831 | | 8/2004 |
| JP | 3587831 | B | 8/2004 |
| JP | 2005-097782 | A | 4/2005 |
| JP | 08-216310 | A | 7/2008 |
| WO | 2005122817 | A1 | 12/2005 |

OTHER PUBLICATIONS

International Search Report of PCT/JP2007/060543 mailed on Jul. 10, 2007.
European Search Report for Application No. EP07743982, mailed Apr. 8, 2010.
International Search Report of PCT/JP2007/061445 issued Jul. 31, 2007.
Office Action issued Aug. 4, 2009, from U.S. Appl. No. 11/748,712, filed May 15, 2007.
Search Report of International Application No. PCT/JP2007/061444 mailed Aug. 7, 2007.
Office Action issued to U.S. Appl. No. 11/755,376 mailed Jun. 30, 2009.
International Search Report of PCT/JP2007/061601 issued Aug. 7, 2007.
Notice of Allowance Issued to U.S. Appl. No. 11/755,376, mailed Jun. 21, 2010.
Office Action issued to U.S. Appl. No. 11/748,712, mailed Mar. 23, 2010.
Office Action issued to CN Application No. 200780022784.6 mailed May 12, 2010.
Office Action issued to U.S. Appl. No. 11/762,421 mailed May 11, 2010.
Office Action issued to U.S. Appl. No. 12/511,115, mailed Sep. 14, 2010.
Office Action issued to ID Application No. W00200804035 mailed Apr. 26, 2011.
Office Action for U.S. Appl. No. 11/755,376 mailed Oct. 15, 2010.
Office Action for U.S. Appl. No. 11/755,376 mailed Nov. 25, 2009.
Office Action for U.S. Appl. No. 12/511,115 mailed Feb. 23, 2011.
European Search Report for European Patent Application No. 07743977.6 issued Apr. 18, 2011.
European Search Report for European Patent Application No. 07743978.4 issued Apr. 18, 2011.
European Search Report for European Patent Application No. 07743979.2 issued Apr. 18, 2011.
European Search Report for European Patent Application No. 07744787.8 issued Apr. 29, 2011.
European Search Report for European Patent Application No. 07743980.0 issued Apr. 18, 2011.
European Search Report for European Patent Application No. 07743981.8 issued Apr. 18, 2011.
European Search Report for European Patent Application No. 07744921.3 issued Apr. 18, 2011.
European Search Report for European Patent Application No. 07744788.6 issued Apr. 29, 2011.
European Search Report for European Patent Application No. 07767438.0 issued Apr. 29, 2011.
Office Action issued to U.S. Appl. No. 11/766,867 mailed Aug. 23, 2011.

* cited by examiner

NONWOVEN FABRIC

This application is based on and claims the benefit of priority from Japanese Patent Application No. 2006-174505, filed on Jun. 23, 2006 and from Japanese Patent Application No. 2006-270106, filed on Sep. 29, 2006, the content of which are incorporated herein by reference.

BACKGROUND OF THE INVENTION

1. Field of the Invention

The present invention relates to nonwoven fabrics.

2. Related Art

Nonwoven fabrics have been used in a wide variety of fields including sanitary materials such as diapers and sanitary napkins, cleaning products such as cleaning wipers and medical supplies such as masks. Nonwoven fabrics are used in various fields, as described above, and it is necessary for nonwoven fabrics to be produced so as to have characteristics and structures suitable for use in each product application.

Nonwoven fabrics are formed, for example, by forming fiber layers (fiber webs) by using either a dry method or a wet method, and binding the fibers that are included within the fiber layers by chemical or thermal bonding, etc. There are methods in which fiber layers are pierced repeatedly with many needles, or an external physical force is applied to the fiber layers such as water flow injection during the process of binding the fibers, which are included within the fiber layers.

These methods, however, only interlace fibers and do not adjust the orientation or arrangement of fibers in the fiber layers, or adjust the shape of fiber layers. In other words, nonwoven fabrics that are produced according to these methods are just plain sheet-like nonwoven fabrics.

It is said to be desirable for the nonwoven fabrics used as surface sheets of absorbent products, for example, to have irregularities in order to maintain or improve texture when specific liquids such as excretory substance are being absorbed. Nonwoven fabrics with surfaces on which irregularities are formed by forming a number of fiber layers containing fibers of different properties for heat contraction on top of the other to be sealed with heat for inducing heat contraction of specific layers, and the method thereof are disclosed in Japanese Patent No. 3587831.

However, the fiber density of this type of nonwoven fabric increases in a number of heat-sealed areas and the nonwoven fabric may further form into a film because a number of fiber layers are formed on top of the other during formation of irregularities and each fiber layer is heat-sealed and combined. Particularly when the fabric is formed into a film, predefined liquids such as excretory substance have more difficulty in rapidly penetrating the material.

SUMMARY OF THE INVENTION

The nonwoven fabric disclosed in JP-A No. 3587831 has a second fiber layer containing fibers that are resistant to shrinking when heat is applied formed on one side or both sides of the first fiber layer, within which include the fibers that shrink when heat is applied, and the fiber layers are sealed and combined in a large number of heat sealed areas. The second fiber layers are protruded to form many convex portions by heat contraction of the first fiber layer in the heat sealed area.

In other words, manufacturing steps of the nonwoven fabrics or the method for manufacturing the nonwoven fabrics described in JP-A No. 3587831 are complicated because a number of fiber layers having different shapes are needed to form irregularities in fiber webs. Moreover, many heat sealed areas in the first and the second fiber layers must be sealed steadily, otherwise convex portions of the second fiber layer are not formed when the first and the second fiber layers fall away during heat contraction. This increases the density of the heat sealed areas, and the resultant film exhibits poor quick penetration characteristics of a predefined liquid, such as excretory substance, in that area. As a result, the predefined liquid is fed and collected into the concave portion and then transferred gradually inwards from the side surface of the concave portion. Furthermore, it is difficult for the predefined liquid to be rapidly transferred because the periphery of the concave portions is consolidated or formed into a film by heat embossing. For this reason, if a large quantity of the predefined liquid is being absorbed at a single moment, or if pressure is added to the nonwoven fabric, liquid may easily overflow from the concave portion. These are the subjects of the present invention.

In the present invention, studies have been conducted on the above subjects, and an objective of the present invention is to provide a nonwoven fabric in which predefined liquid can be rapidly transferred, and at least sparsity and density are adjusted.

The present inventors have found that it is possible to prepare a nonwoven fabric so that a predefined liquid can be rapidly transferred by jetting a fluid consisting mainly of gaseous matter to a fiber web, which is supported from beneath by a predefined breathable support member, from an upper surface side in order to move a fiber that are constituting up the fiber web, and completed the present invention.

According to a first embodiment of the present invention, a nonwoven fabric having a first direction and a second direction including: a pluarity of jetted areas to which a fluid is jetted; and a pluarity of nonjetted areas to which the fluid is not jetted, in which the nonwoven fabric is formed by jetting the fluid, including mainly of gaseous matter, to a fiber aggregate, and a fiber density of each of the jetted areas is less than a fiber density of each of the nonjetted areas.

In a second embodiment of the nonwoven fabric as described in the first embodiment of the present invention, a weight of each of the jetted areas is less than a weight of each of the nonjetted areas.

In a third embodiment of the nonwoven fabric as described in the first and second embodiments of the present invention, the content of a fiber oriented in a first direction is less than the content of a fiber oriented in a second direction in each of the jetted areas.

In a fourth embodiment of the nonwoven fabric as described in any one of the first to third embodiments of the present invention, a value of the percent open area measured from a first surface side in the thickness direction of the nonwoven fabric is greater than a value of the percent of open area measured from a second surface side which is opposite to the first surface side in each of the nonjetted areas.

In a fifth embodiment of the nonwoven fabric as described in any one of the first to fourth embodiments of the present invention, each of the jetted areas includes a number of groove portions hollowed in the thickness direction of the nonwoven fabric on the first surface side of the nonwoven fabric, and each of the nonjetted areas are disposed along each of the groove portions and include a number of convex portions protruding in the thickness direction on the first surface side.

In a sixth embodiment of the nonwoven fabric as described in the fifth embodiment of the present invention, each of the convex portions includes side portions formed on both sides of the convex portions, and the fiber density of each of the side portions is greater than the fiber density of each of the groove portions.

In a seventh embodiment of the nonwoven fabric as described in the sixth embodiment of the present invention, the fiber density of each of the side portions is greater than the fiber density of the center portions that are sandwiched between the side portions of each of the convex portions.

In an eighth embodiment of the nonwoven fabric as described in any one of the fifth to seventh embodiments of the present invention, a difference between the value of the percent open area measured from the first surface side and the value of the percent open area measured from the second surface side is no less than 5% in each of the convex portions.

In a ninth embodiment of the nonwoven fabric as described in any one of the fifth to eighth embodiments of the present invention, the fiber density of each of the groove portions is no greater than 0.18 g/cm$^3$, and the fiber density of each of the convex portions is no greater than 0.20 g/cm$^3$.

In a tenth embodiment of the nonwoven fabric as described in any one of the fifth to ninth embodiments of the present invention, each of the groove portions includes a number of sparse areas where the fiber density is less than an average fiber density of a bottom portion formed at a bottom of the groove portions.

In an eleventh embodiment of the nonwoven fabric as described in the tenth embodiment of the present invention, the sparse areas are openings.

In a twelfth embodiment of the nonwoven fabric as described in the eleventh embodiment of the present invention, the fiber density of a peripheral border of each of the openings is greater than the fiber density of the area sandwiched between the openings in the groove portions.

In a thirteenth embodiment of the nonwoven fabric as described in the eleventh and twelfth embodiments of the present invention, the fiber in the peripheral border of each of the openings is oriented along the peripheral border of each of the openings.

In a fourteenth embodiment of the nonwoven fabric as described in any one of the fifth to thirteenth embodiments of the present invention, a specific convex portion of the convex portions differs from the convex portions which lie adjacent to the specific convex portion across a specific groove portion of the groove portions in height in the thickness direction.

In a fifteenth embodiment of the nonwoven fabric as described in any one of the fifth to fourteenth embodiments of the present invention, a top of each of the convex portions includes a substantially flattened shape.

In a sixteenth embodiment of the nonwoven fabric as described in any one of the fifth to fifteenth embodiments of the present invention, a number of areas protruding in the direction opposite to the direction in which the convex portions protrude are formed on the second surface side.

In a seventeenth embodiment of the nonwoven fabric as described in any one of the fifth to sixteenth embodiments of the present invention, the nonwoven fabric includes a substantially corrugated shape in the first direction.

In an eighteenth embodiment of the nonwoven fabric as described in any one of the first to fifteenth embodiments of the present invention, the second surface side of the nonwoven fabric is a substantially planar surface.

In a nineteenth embodiment of the nonwoven fabric as described in any one of the first to eighteenth embodiments of the present invention, the fiber configuring the fiber aggregate includes a water-repellent fiber.

Provided by the present invention is a nonwoven fabric in which a predefined liquid can be rapidly transferred and at least sparsity and density are adjusted.

DETAILED DESCRIPTION OF THE INVENTION

The best embodiments of the present invention will be explained referring to figures below.

Figure 1:
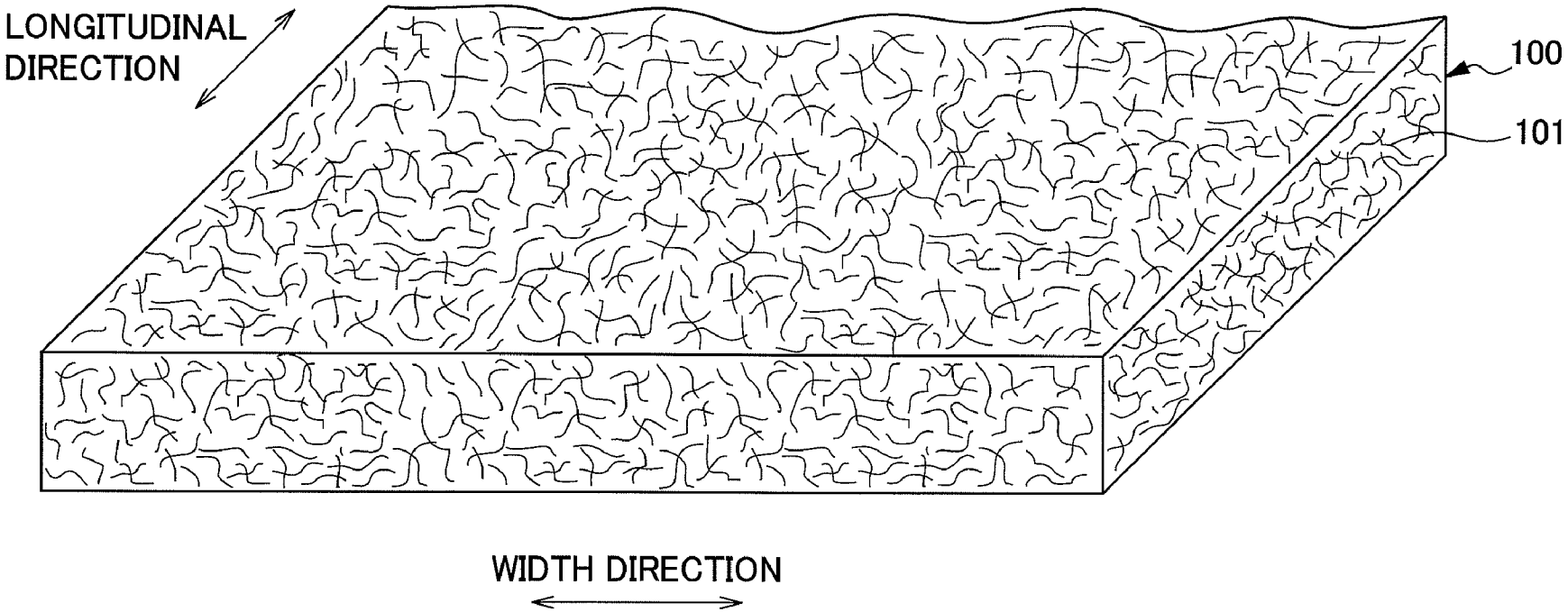
FIG. 1 shows a perspective view of a fiber web.
Figure 2A:
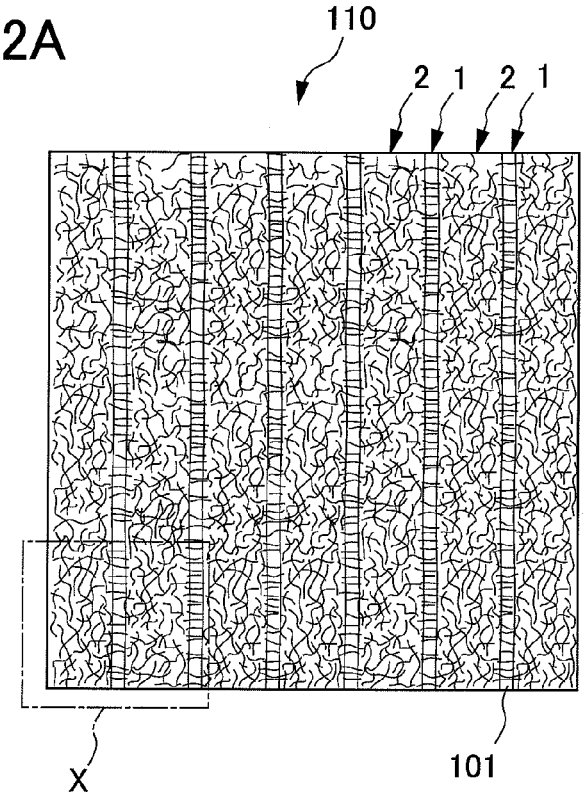
FIG. 2A shows a top view of a nonwoven fabric as described in the first embodiment.
Figure 2B:
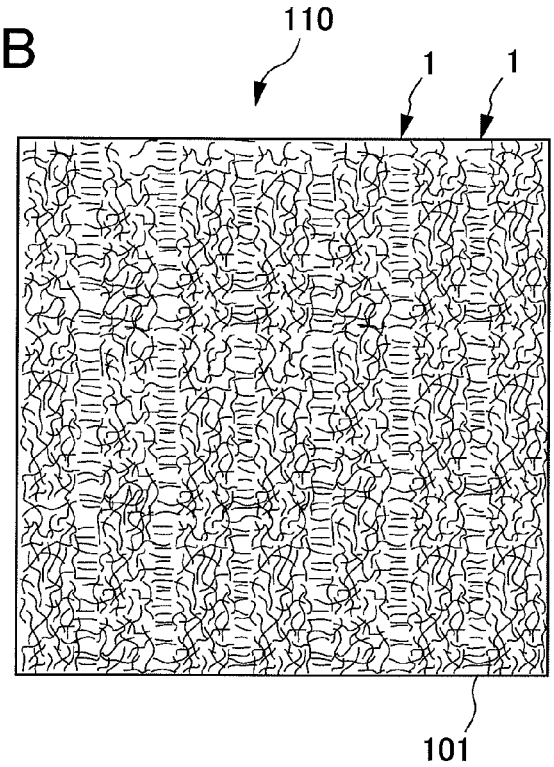
FIG. 2B shows a bottom view of a nonwoven fabric as described in the first embodiment.
Figure 3:
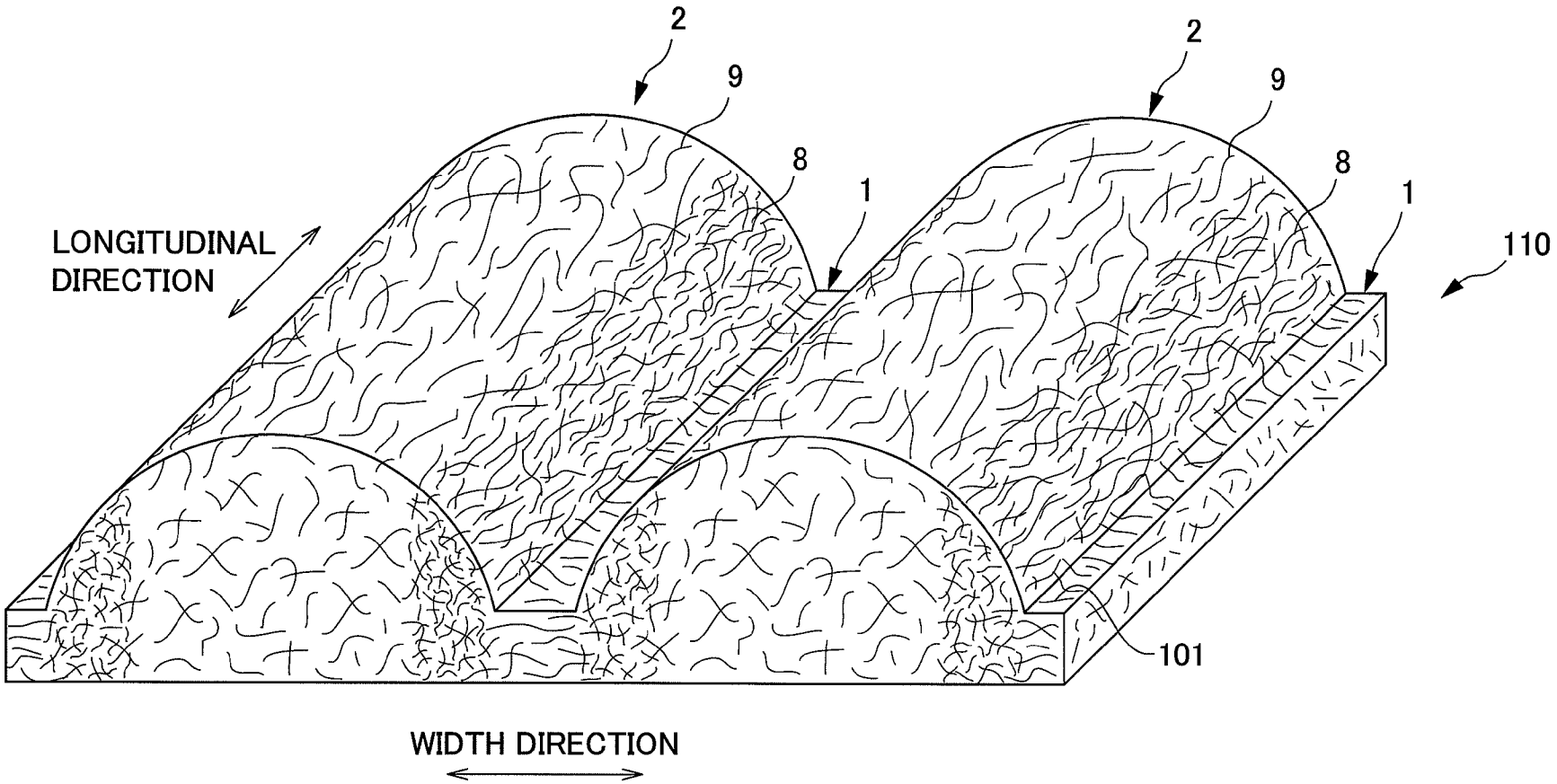
FIG. 3 shows an enlarged perspective view of an area X as defined in FIG. 2.
Figure 4A:
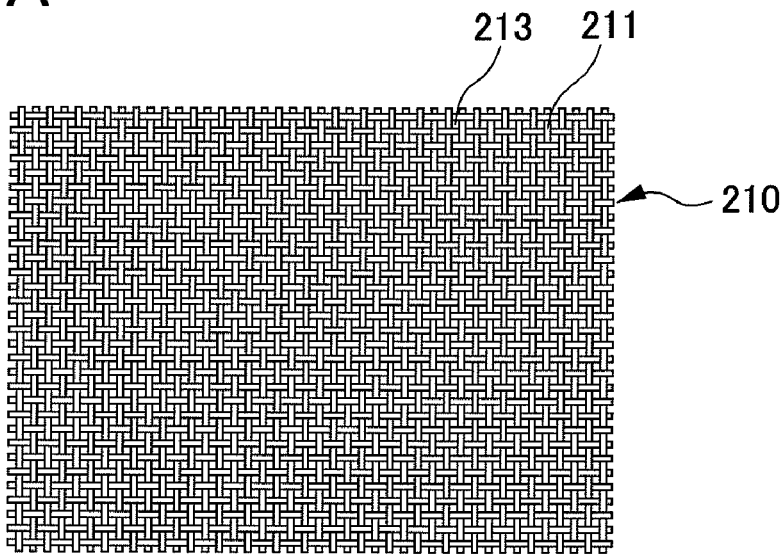
FIG. 4A shows a top view of a net-like support member.
Figure 4B:
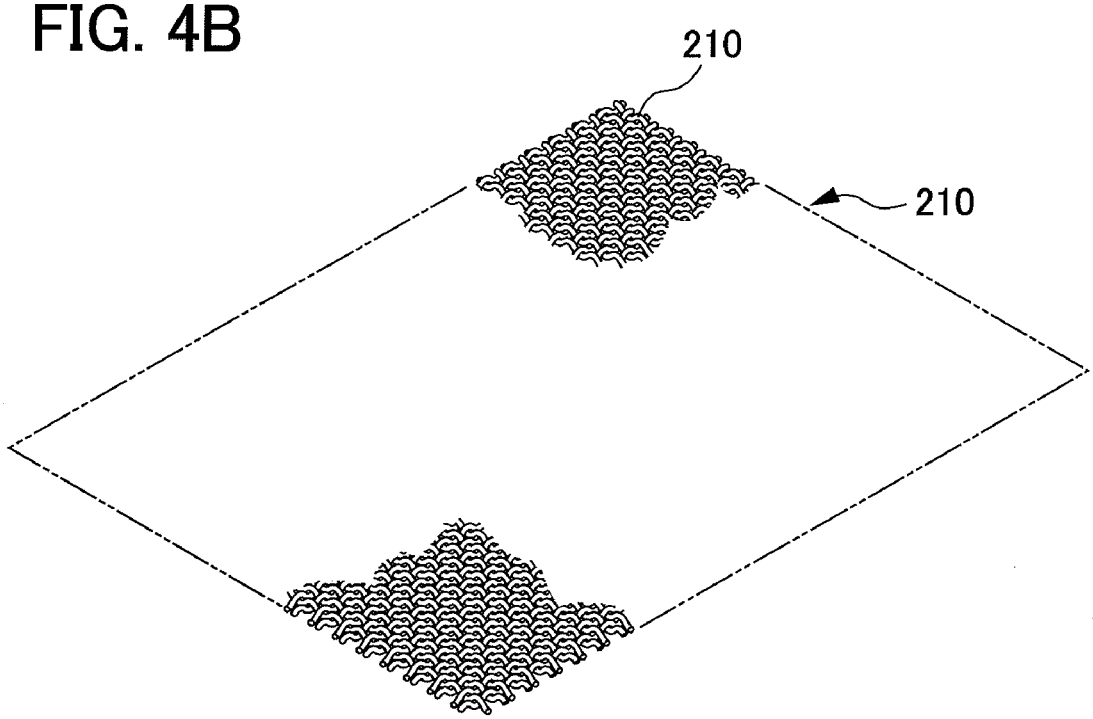
FIG. 4B shows a perspective view of a net-like support member.
Figure 5:
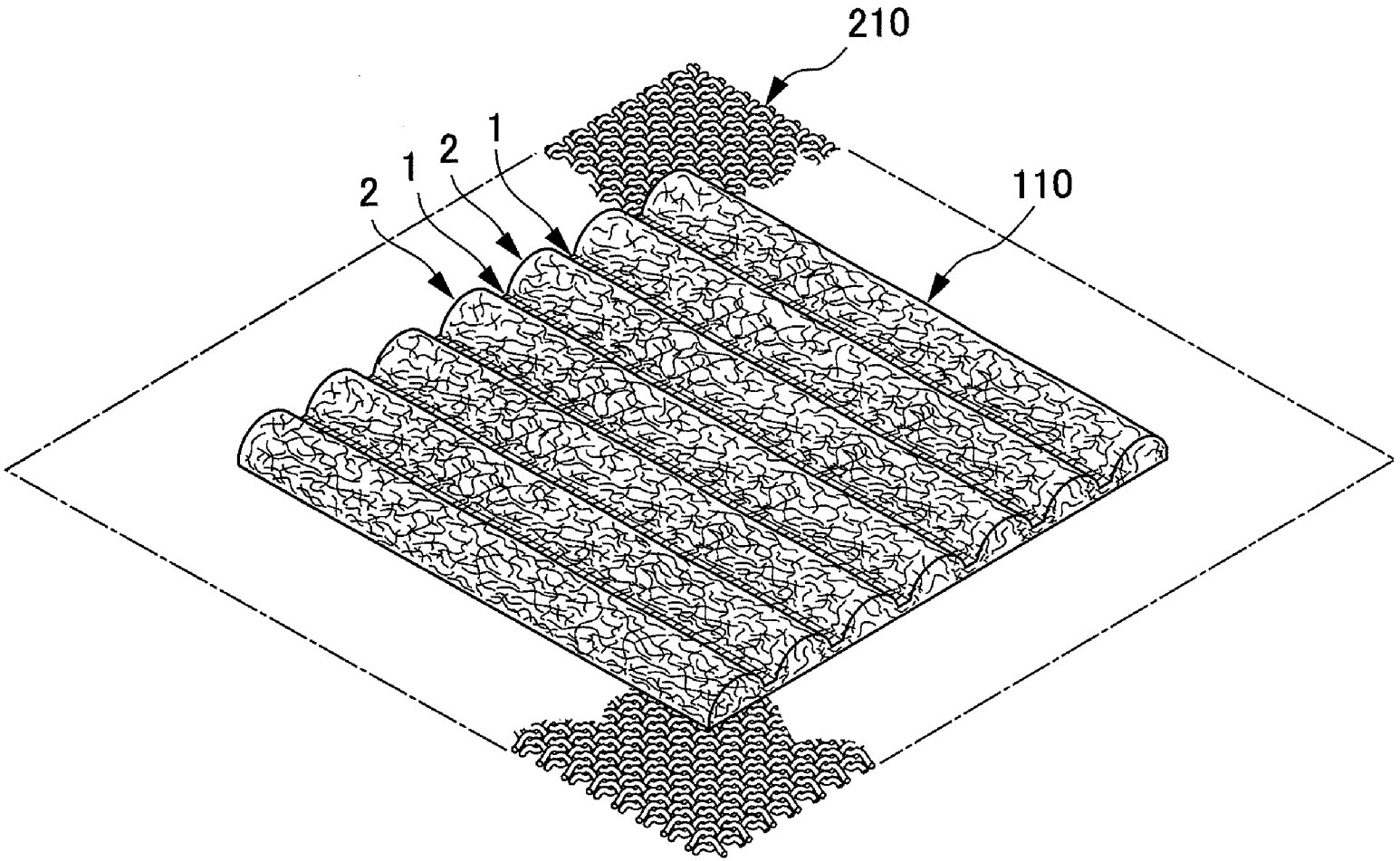
FIG. 5 shows a perspective view of the nonwoven fabric as described in the first embodiment of FIG. 2, manufactured by jetting a gaseous matter to an upper surface side of the fiber web as described in FIG. 1, while being supported from beneath by the net-like support member as described in FIG. 4.
Figure 6:
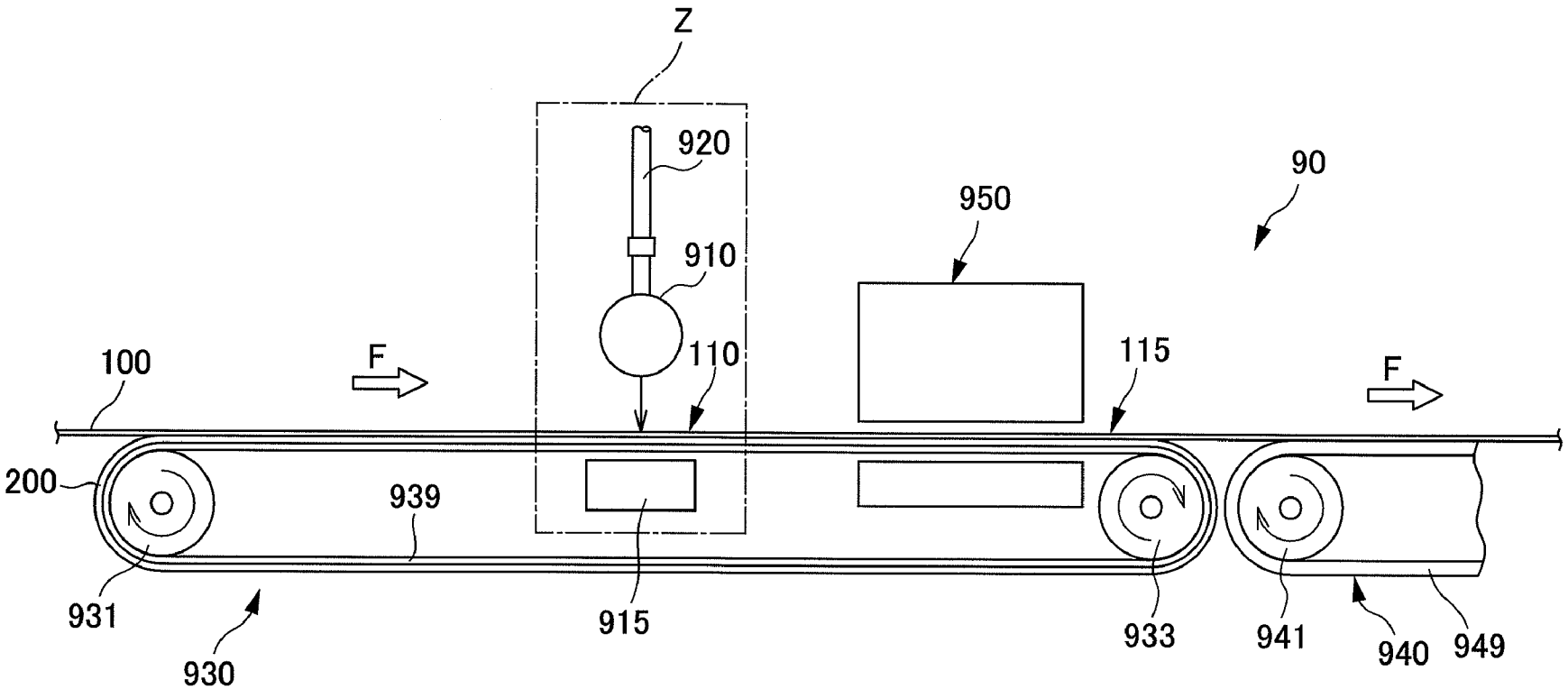
FIG. 6 shows a side view for explaining a nonwoven fabric manufacturing apparatus according to the first embodiment.
Figure 7:
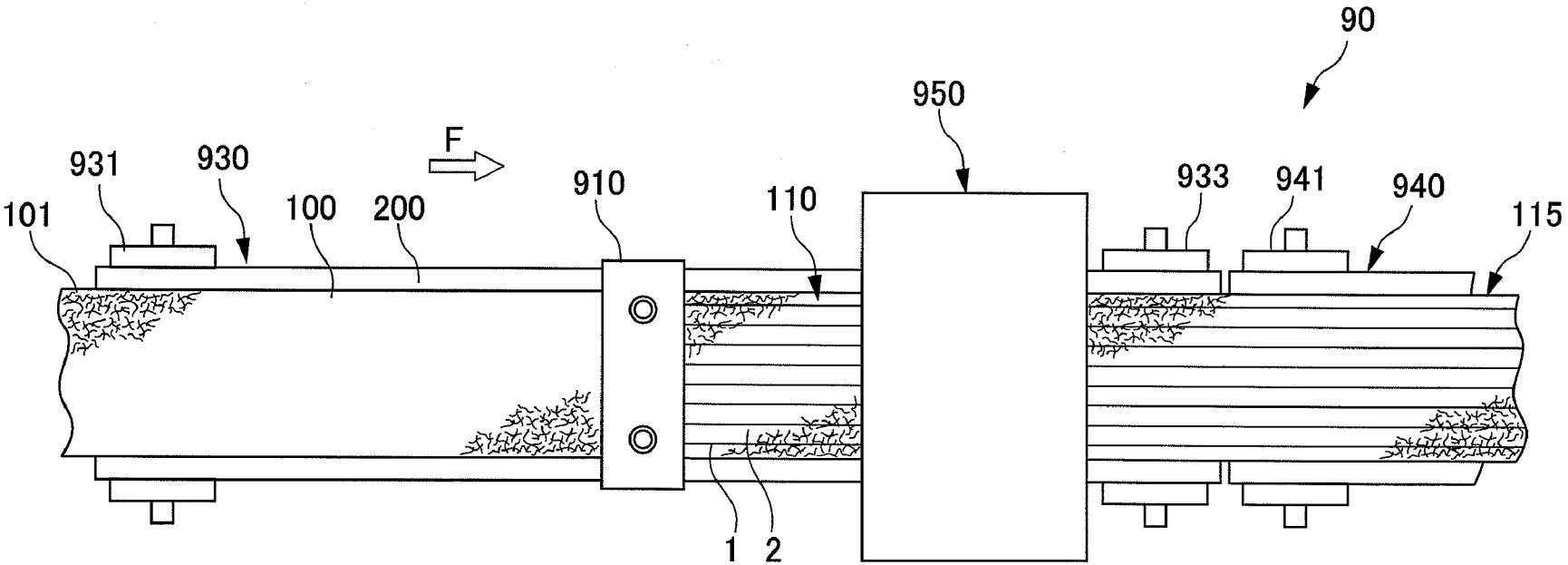
FIG. 7 shows a top view for explaining the nonwoven fabric manufacturing apparatus as described in FIG. 6.
Figure 8:
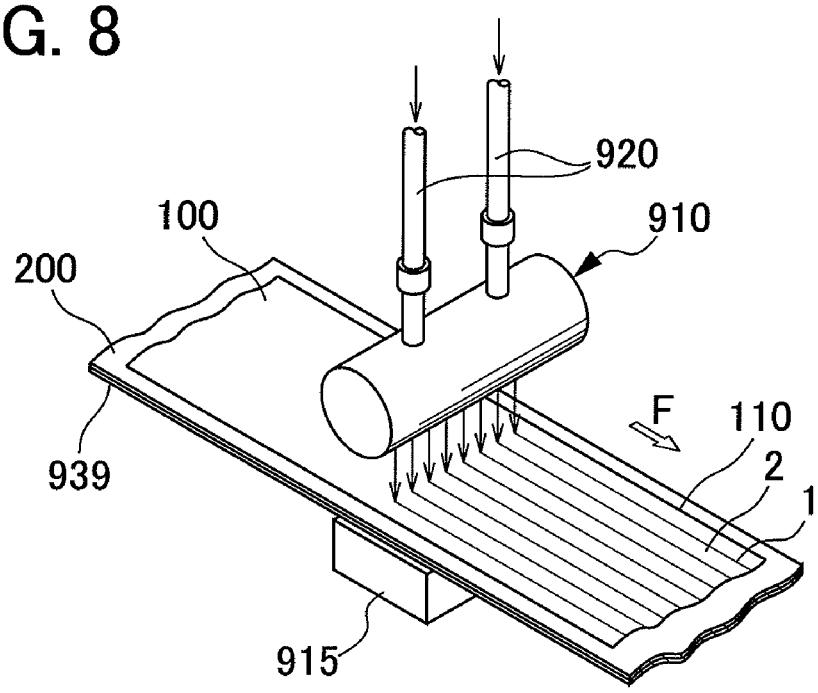
FIG. 8 shows an enlarged perspective view of an area Z as defined in FIG. 6.
Figure 9:
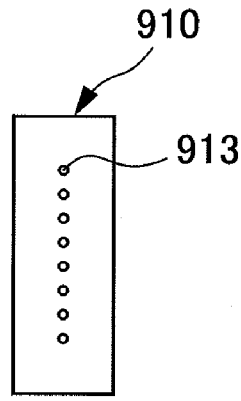
FIG. 9 shows a bottom view of an ejection unit as described in FIG. 8.
Figure 10:
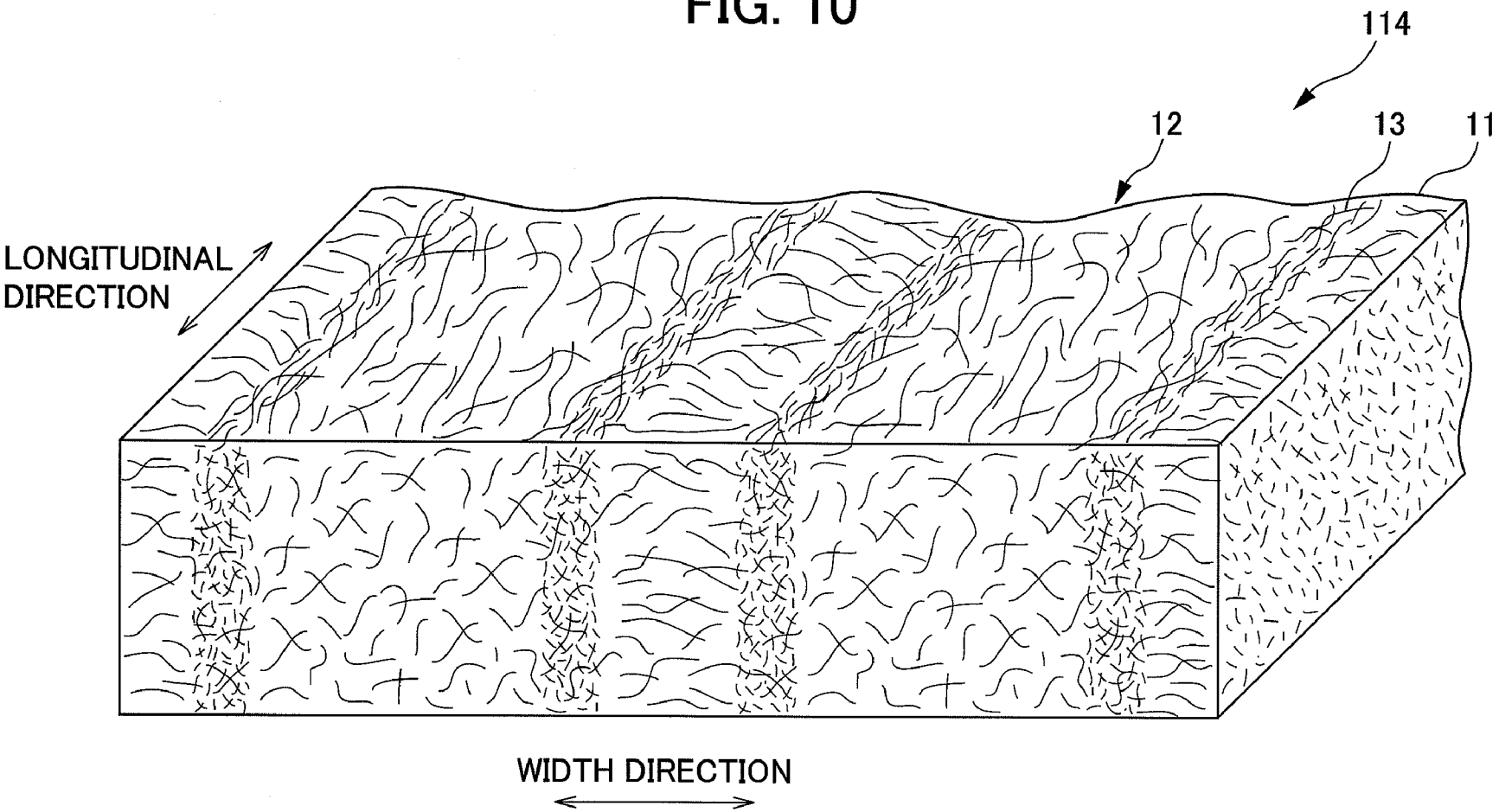
FIG. 10 shows an enlarged perspective view of a nonwoven fabric according to the second embodiment.
Figure 11:
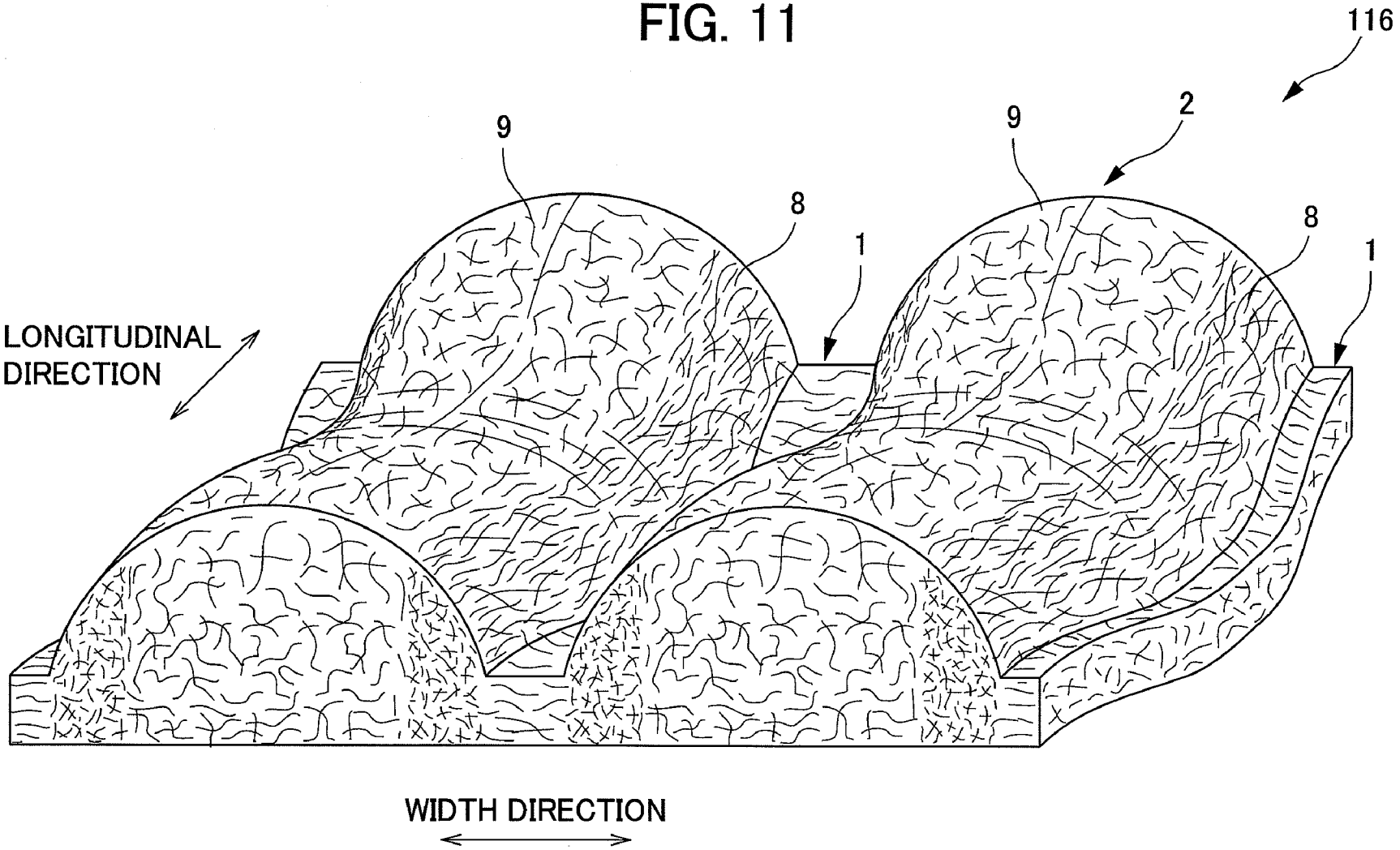
FIG. 11 shows an enlarged perspective view of a nonwoven fabric according to the third embodiment.
Figure 12:
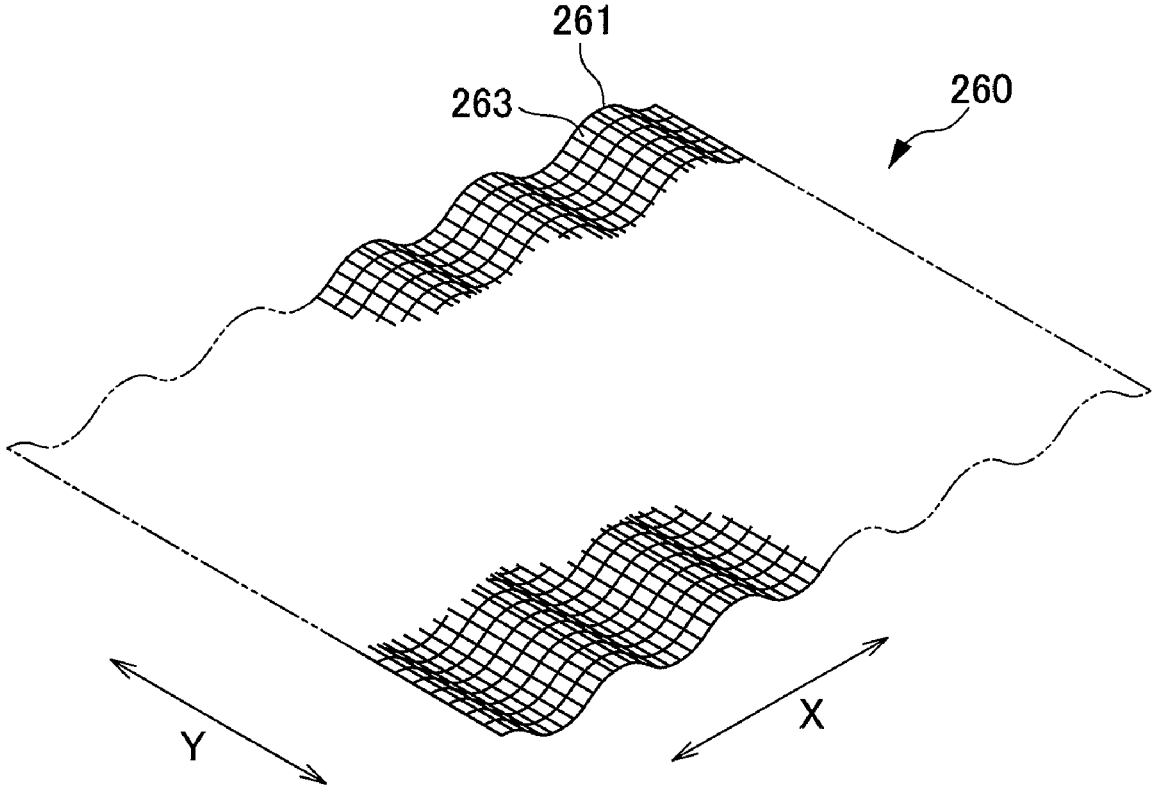
FIG. 12 shows an enlarged perspective view of a net-like support member according to the third embodiment.
Figure 13:
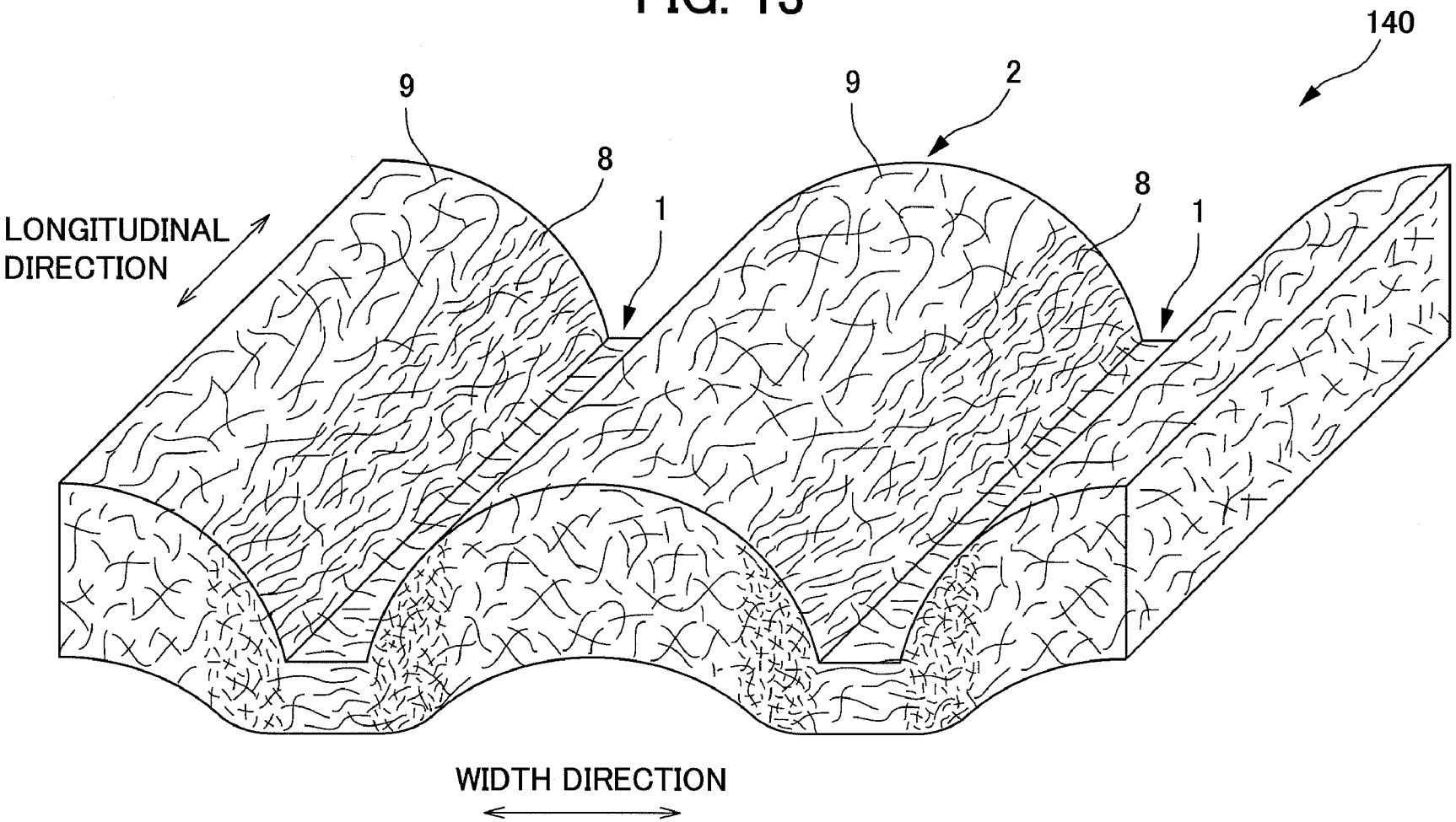
FIG. 13 shows an enlarged perspective view of a nonwoven fabric according to the fourth embodiment.
Figure 14:
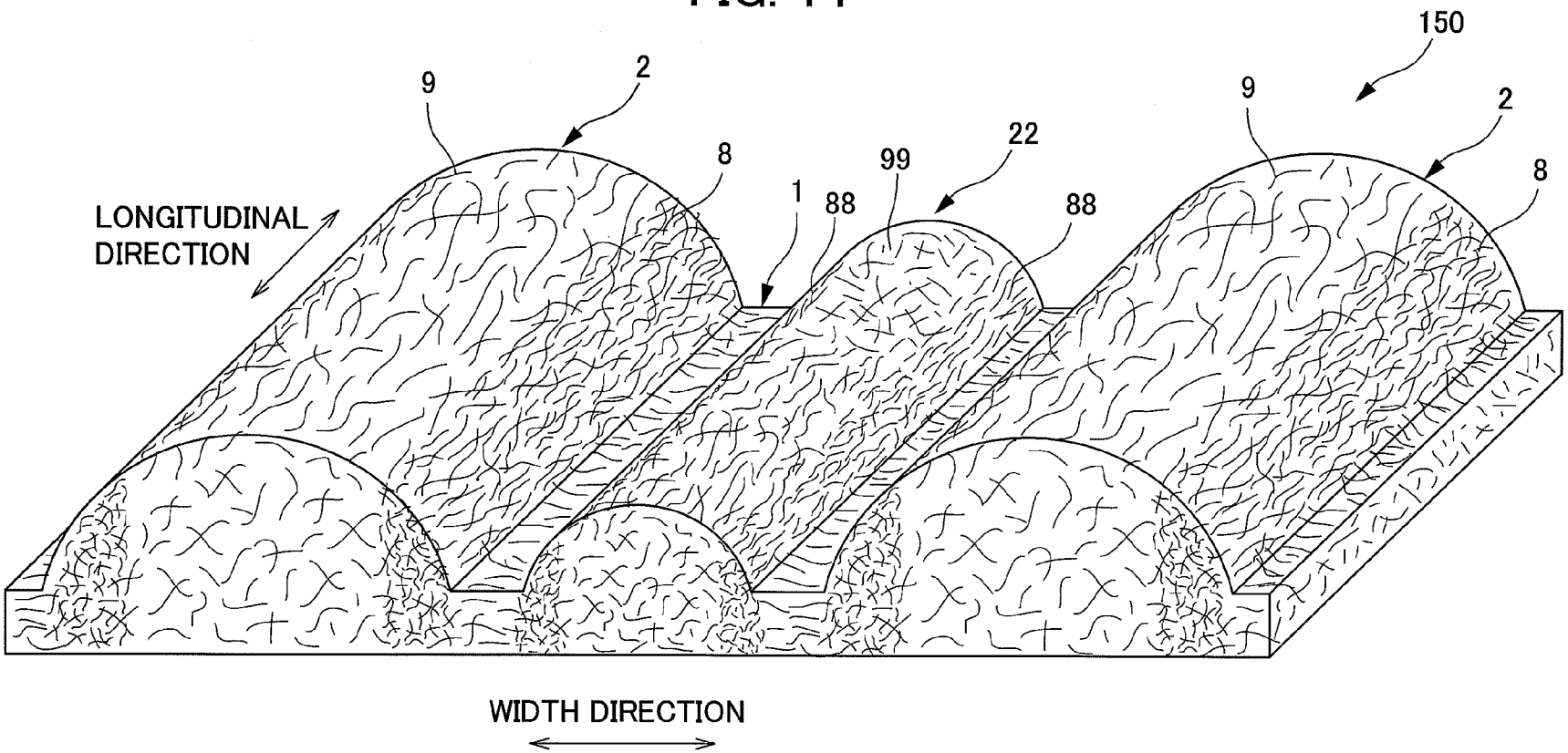
FIG. 14 shows an enlarged perspective view of a nonwoven fabric according to the fifth embodiment.
Figure 15:
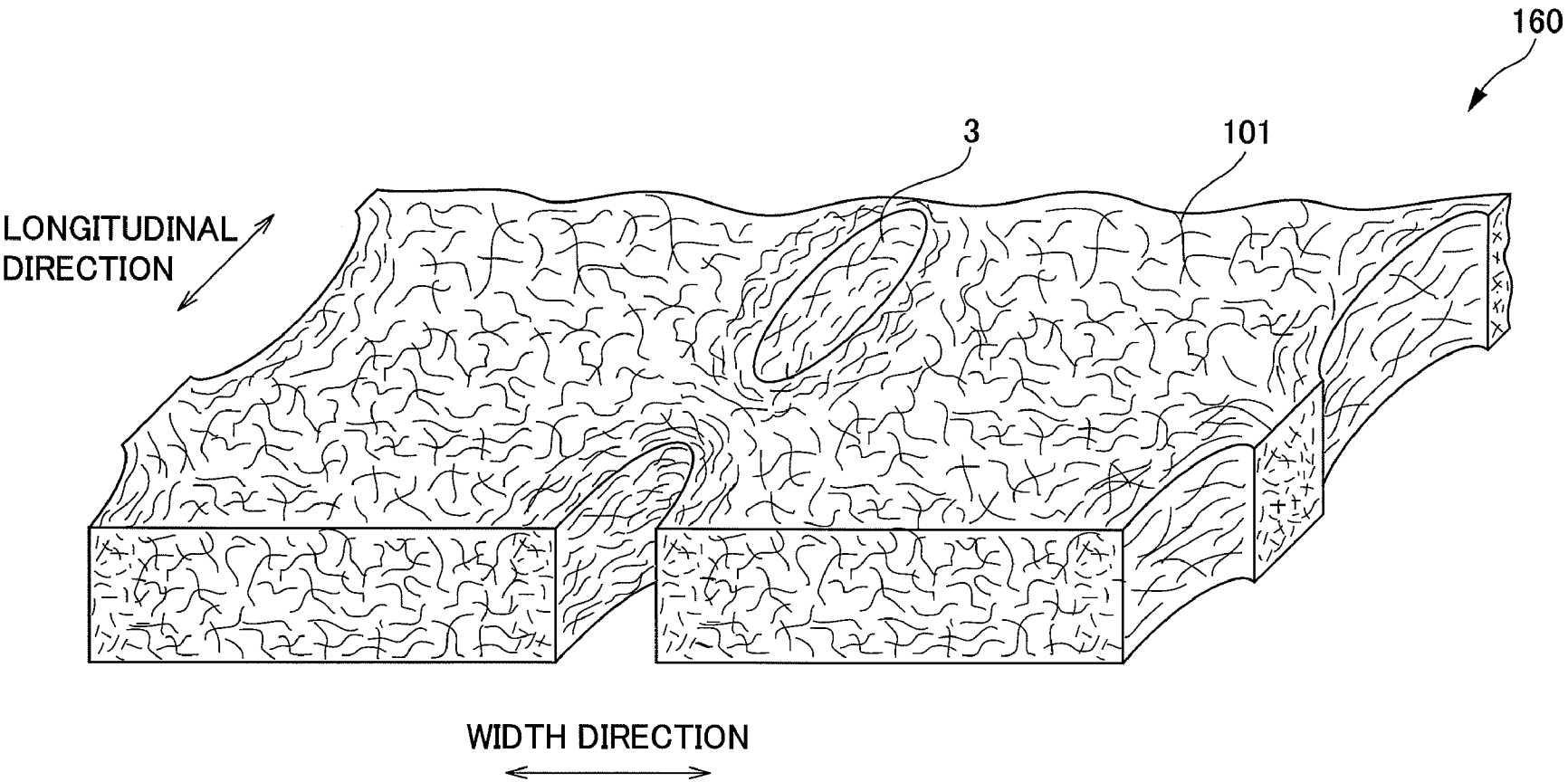
FIG. 15 shows an enlarged perspective view of a nonwoven fabric according to the sixth embodiment.
Figure 16A:
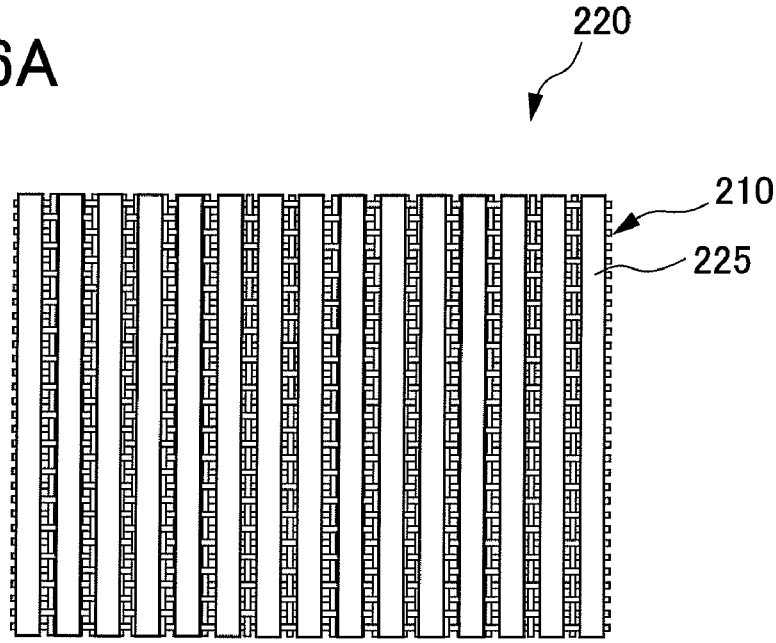
FIG. 16A shows a top view of a support member for use in manufacturing the nonwoven fabric as described in FIG. 15.
Figure 16B:
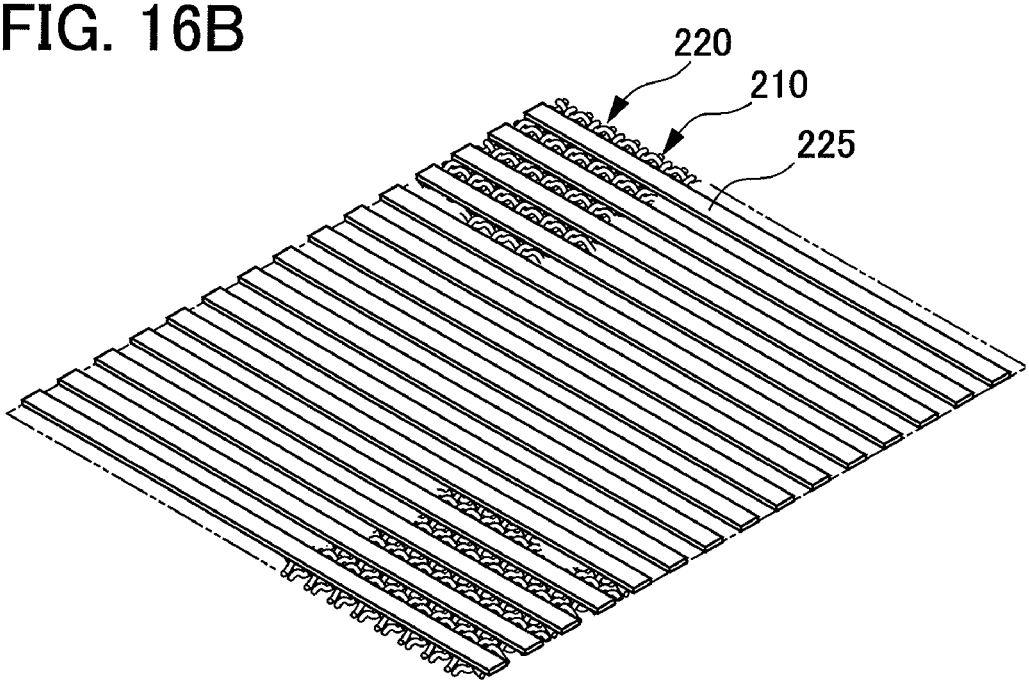
FIG. 16B shows a perspective view of a support member for use in manufacturing the nonwoven fabric as described in FIG. 15.
Figure 17:
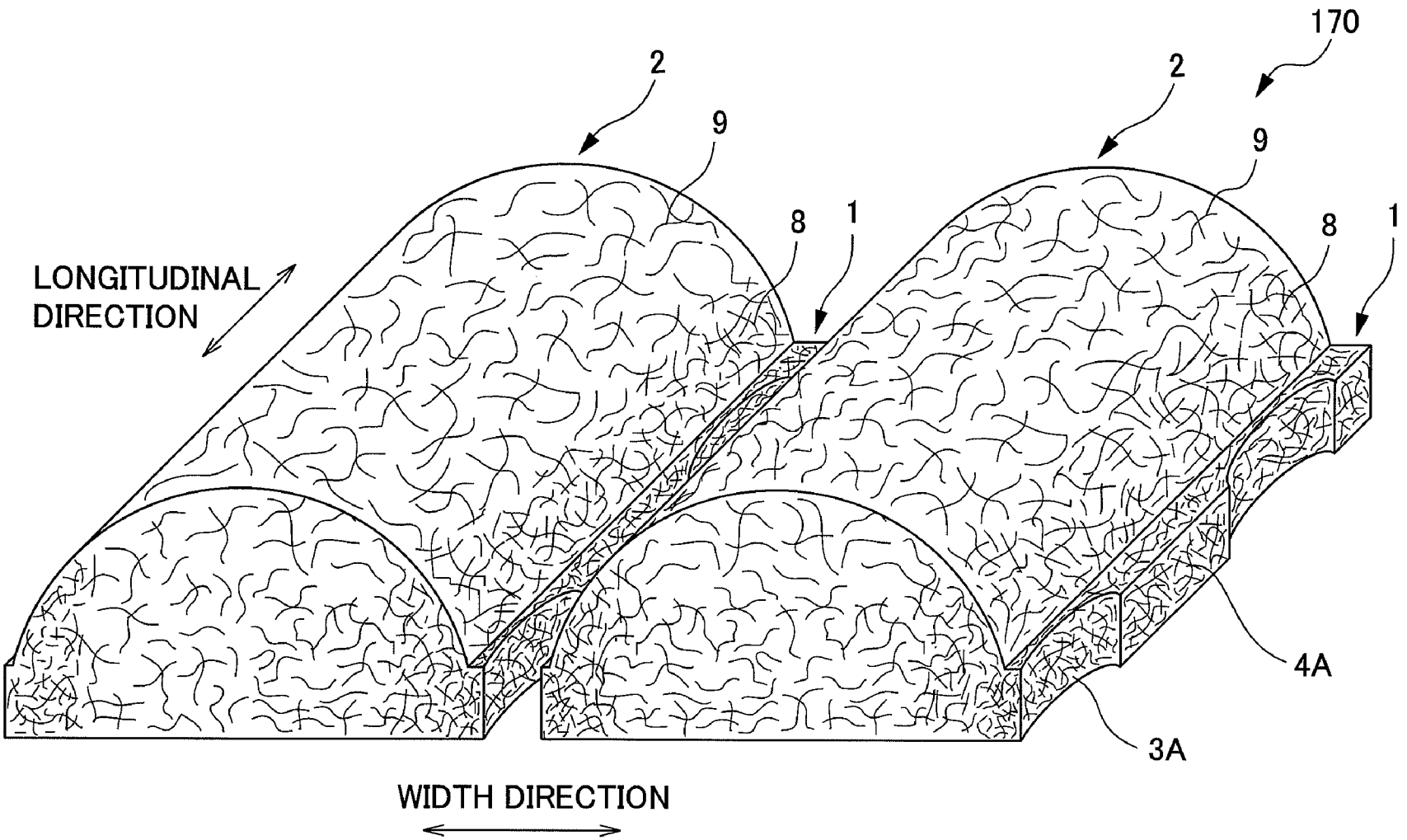
FIG. 17 shows an enlarged perspective view of a nonwoven fabric according to the seventh embodiment.
Figure 18:
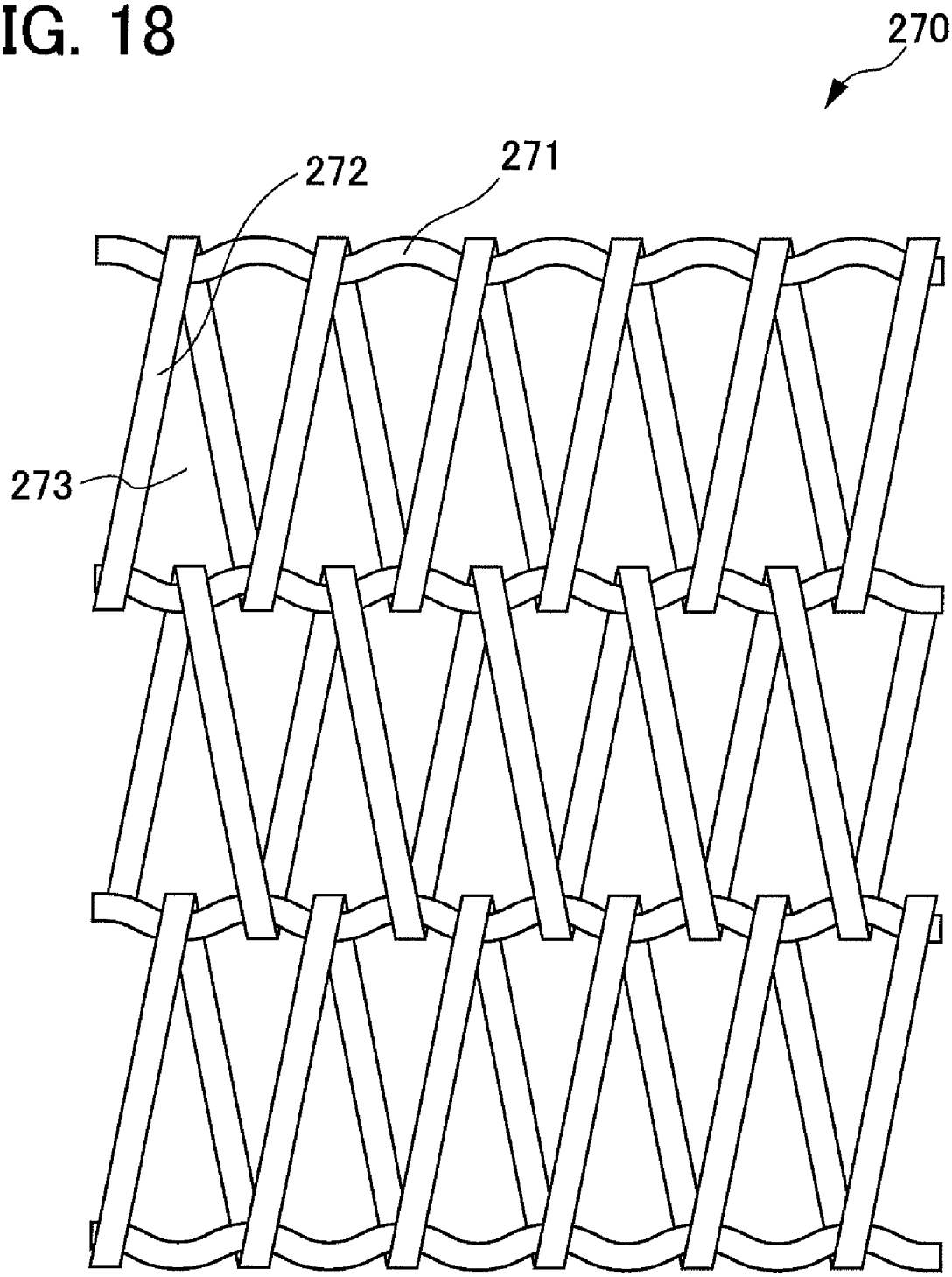
FIG. 18 shows an enlarged top view of a support member for use in manufacturing the nonwoven fabric as described in FIG. 17.
Figure 19:
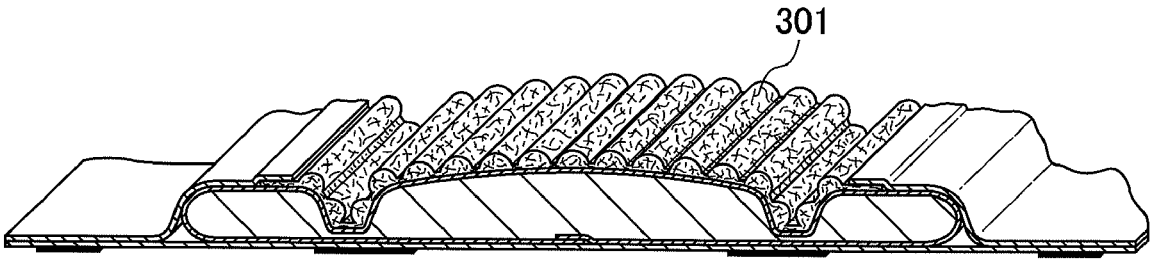
FIG. 19 shows a perspective cross section of a nonwoven fabric of the present invention used as a surface sheet of sanitary napkins.
Figure 20:
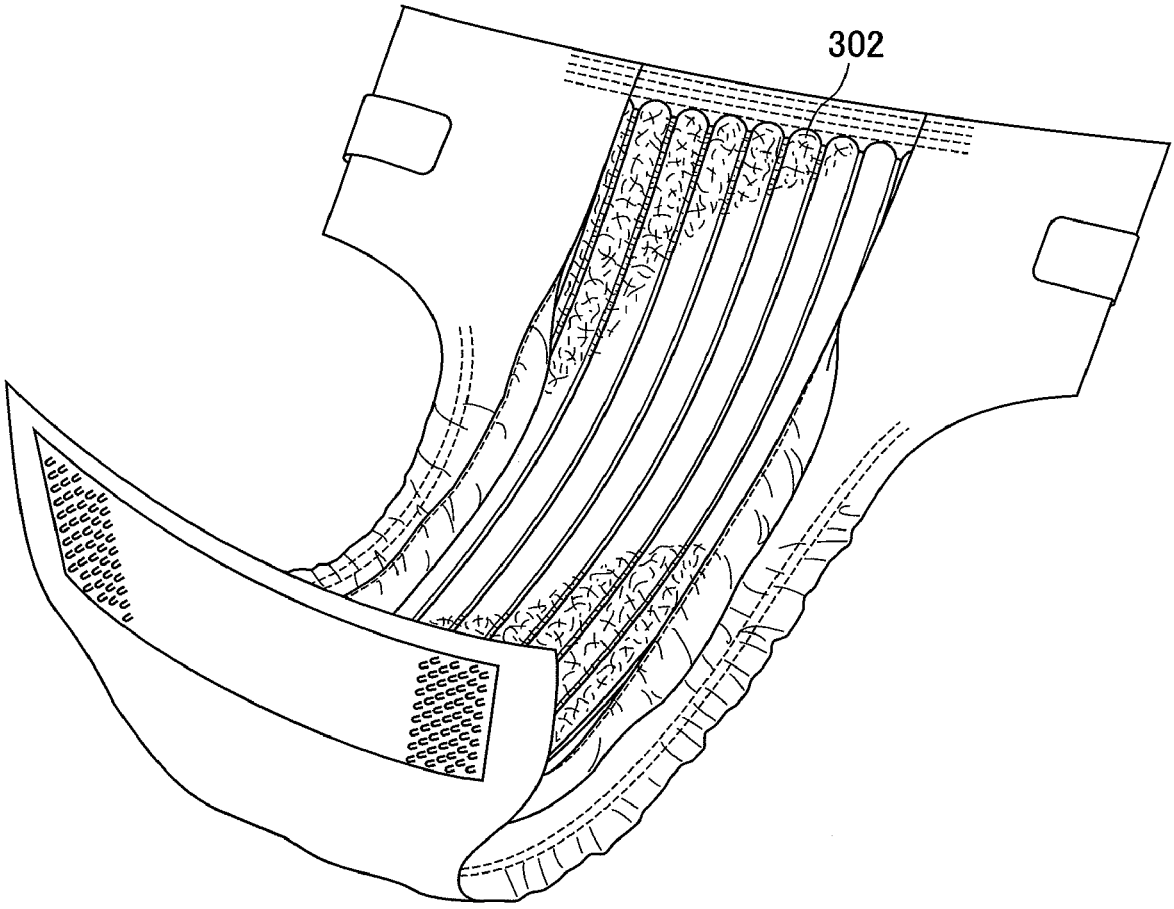
FIG. 20 shows a perspective view of a nonwoven fabric of the present invention used as a surface sheet of diapers.
Figure 21:
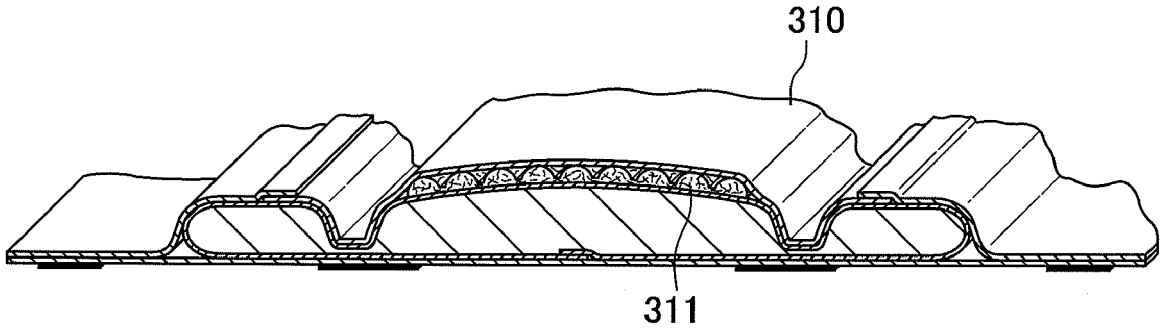
FIG. 21 shows a perspective cross section of a nonwoven fabric of the present invention used as an intermediate sheet of absorbent products.
Figure 22:
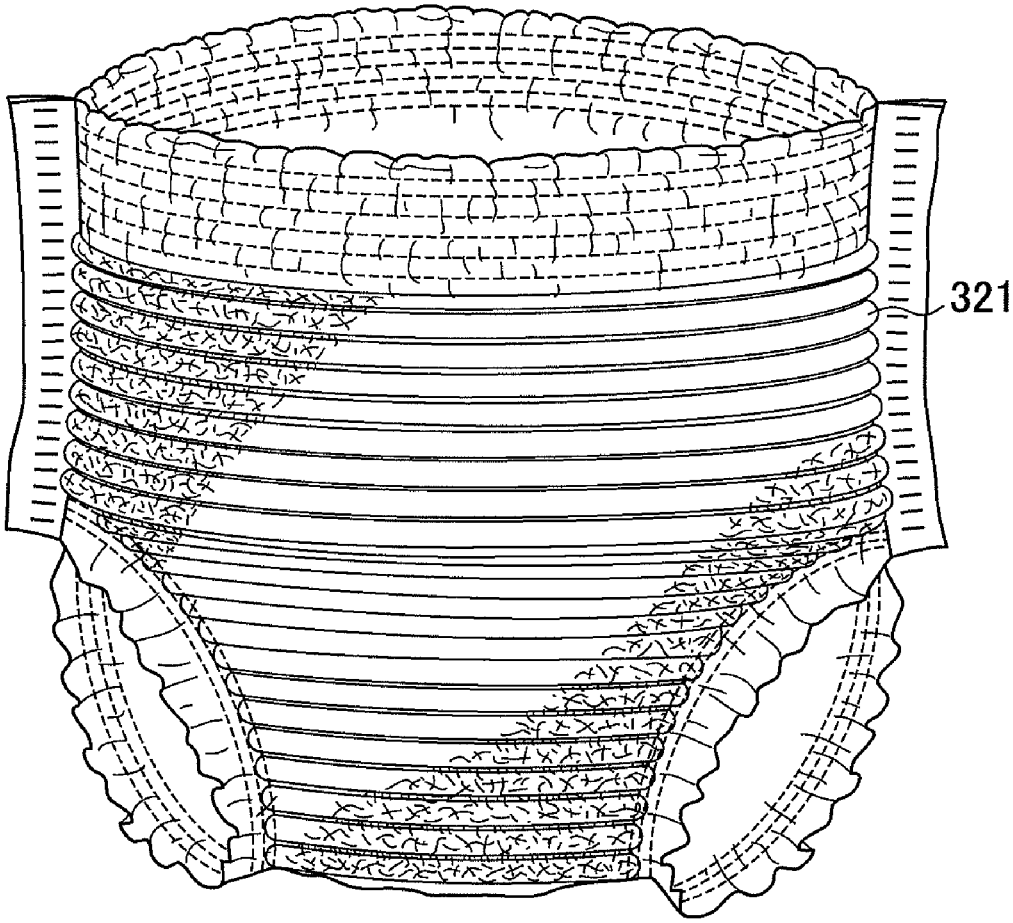
FIG. 22 shows a perspective view of a nonwoven fabric of the present invention used as an outermost of absorbent products.

FIG. 1 shows a perspective view of a fiber web. FIG. 2A shows a top view of a nonwoven fabric as described in the first embodiment. FIG. 2B shows a bottom view of a nonwoven fabric as described in the first embodiment. FIG. 3 shows an enlarged perspective view of an area X as defined in FIG. 2. FIG. 4A shows a plan view of a net-like support member. FIG. 4B shows a perspective view of a net-like support member. FIG. 5 is a view showing a nonwoven fabric as described in the first embodiment of FIG. 2, manufactured by injecting a gaseous matter to an upper surface side of the fiber web, as described in FIG. 1, while being supported from beneath by the net-like support member described in FIG. 4. FIG. 6 shows a side view for explaining a nonwoven fabric manufacturing apparatus according to the first embodiment. FIG. 7 shows a top view for explaining the nonwoven fabric manufacturing apparatus as described in FIG. 6. FIG. 8 shows an enlarged perspective view of an area Z, as defined in FIG. 6. FIG. 9 shows a bottom view of an ejection unit as described in FIG. 8. FIG. 10 shows an enlarged perspective view of a nonwoven fabric according to the second embodiment. FIG. 11 shows an enlarged perspective view of a nonwoven fabric according to the third embodiment. FIG. 12 shows an enlarged perspective view of a net-like support member according to the third embodiment. FIG. 13 shows an enlarged perspective view of a nonwoven fabric according to the fourth embodiment. FIG. 14 shows an enlarged perspective view of a nonwoven fabric according to the fifth embodiment. FIG. 15 shows an enlarged perspective view of a nonwoven fabric according to the sixth embodiment. FIG. 16A shows a top view of a support member for use in manufacturing the nonwoven fabric as described in FIG. 15. FIG. 16B shows a perspective view of a support member for use in manufacturing the nonwoven fabric as described in FIG. 15. FIG. 17 shows an enlarged perspective view of a nonwoven fabric according to the seventh embodiment. FIG. 18 shows an enlarged top view of a support member for use in manufacturing the nonwoven fabric as described in FIG. 17. FIG. 19 shows a perspective cross section of a nonwoven fabric of the present invention used as a surface sheet of sanitary napkins. FIG. 20 shows a perspective view of a nonwoven fabric of the present invention used as a surface sheet of diapers. FIG. 21 shows a perspective cross section of a nonwoven fabric of the present invention used as an intermediate sheet of absorbent products. FIG. 22 shows a perspective view of a nonwoven fabric of the present invention used as an outer back of absorbent products.

1. First Embodiment

The nonwoven fabric of the present invention according to the first embodiment will be explained while referring to FIGS. 2 to 5.

The nonwoven fabric 110 according to the first embodiment is a nonwoven fabric formed by jetting a fluid, consisting mainly of gaseous matter, into a fiber aggregate. A groove portion 1, which is an injected area to which the fluid, consisting mainly of gaseous matter, is jetted, and a convex portion 2, which is a nonjetted area to which the fluid, consisting mainly of gaseous matter, is not jetted, are formed. Furthermore, the nonwoven fabric 110 is a nonwoven fabric which has been adjusted so as the fiber density of the groove portion 1 to less than the fiber density of the convex portion 2.

1.1. Shape

In the nonwoven fabric 110 according to the first embodiment, a number of groove portions 1 are formed in parallel with each other at approximately regular intervals on one side of the nonwoven fabric 110 as shown in FIGS. 2A, 2B and 3. A number of convex portions 2 are formed between each of the groove portions 1 formed at approximately regular intervals. The convex portions 2 are formed in parallel with each other at approximately regular intervals similarly to the groove portions 1.

The height of the convex portions 2 in the thickness direction of the nonwoven fabric 110 according to the first embodiment is 0.3 mm to 15 mm and preferably 0.5 mm to 5 mm, for example. The length of one convex portion 2 in the width direction is 0.5 mm to 30 mm and preferably 1.0 mm to 10 mm. The distance between tops of adjacent convex portions 2 across the groove portion 1 is 0.5 mm to 30 mm and preferably 3 mm to 10 mm, for example.

The length of the groove portion 1 in the thickness direction of the nonwoven fabric 110 is no greater than 90%, preferably 1% to 50% and more preferably 5% to 20% of the height of the convex portion 2, for example. The length of the groove 1 in the width direction is 0.1 mm to 30 mm and preferably 0.5 mm to 10 mm, for example. The pitch between adjacent groove portions 1 across the convex portion 2 is 0.5 mm to 20 mm and preferably 3 mm to 10 mm, for example.

When the nonwoven fabric 110 is used as a surface sheet of absorbent products, for example, the groove portions 1, which are suitable for making a large quantity of predefined liquids less likely to spread broadly on the surface during excretion, can be formed by following the above dimensions. Even if the convex portions 2 are crushed under excessive external pressure, the spaces in the groove portions 1 are likely to be maintained, thereby making a predefined liquid less likely to spread broadly on the surface during excretion or under external pressure. Furthermore, even if the predefined liquid once absorbed by an absorber reverses its course as a result of external pressure, it is unlikely to excessively reattach to the skin because of the irregularities formed on the surface of the nonwoven fabric 110, decreasing the contact area with the skin.

The measurement methods of height, pitch and width of the groove portion 1 or convex portion 2 are as follows. For example, a nonwoven fabric 110 is placed on a table in the absence of pressure, and measurements are taken from a cross sectional photograph or a cross sectional image of the nonwoven fabric 110 by means of a microscope. Meanwhile, the sample of nonwoven fabric 110 is cut through the convex portion 2 and the groove portion 1.

When height in the thickness direction is measured, it is determined by measuring from the lowest point (surface of the table) of the nonwoven fabric 110 to each of the highest points of the convex portion 2 and the groove portion 1.

Pitch is determined by measuring the distance between the tops of adjacent convex portions 2 and the same is done for the groove portions 1.

Width is determined by measuring the greatest width from the lowest point (surface of the table) of the nonwoven fabric 110 to the base of the convex portion 2 and the greatest width of the base of the groove portion 1 is measured similarly.

The cross sectional shape of the convex portion 2 is not particularly limited. Examples may include dome, trapezoidal, triangular, Ω-like and tetragonal shapes. It is preferable for sides and near tops of the convex portions 2 to be curved in order to improve the texture. Moreover, to be able to keep spaces by groove portions 1 when the convex portions 2 are crushed under external pressure, it is preferable for the width between the base to the top of the convex portions 2 to be narrow. Examples of preferable cross sectional shapes of the convex portions 2 include curved line (curved surface) such as approximate dome shape.

The groove portions 1 according to the first embodiment are formed in parallel with each other at approximately regular intervals, however, they are not limited to the above and may be formed at irregular intervals, or may not be in parallel with each other and the intervals between groove portions 1 may also vary.

Even though heights (in the thickness direction) of the convex portions 2 of the nonwoven fabric 110 according to the first embodiment are approximately uniform, the convex portions 2 may be formed so that the adjacent convex portions 2 have different heights. For example, heights of the convex portions 2 can be adjusted by regulating intervals of the ejection holes 913, as will be described later, from which fluids, consisting mainly of gaseous matter are ejected. For example, the height of the convex portions 2 can be decreased by narrowing the intervals of the ejection holes 913, and alternatively, the height of the convex portions 2 can be increased by widening the intervals of the ejection holes 913. Furthermore, the convex portions 2 having different heights can be formed alternately by forming the ejection holes 913 at a narrow interval and a wide interval in alternate fashion. If the heights of the convex portions 2 are partially changed, the contact area with skin is reduced, thereby reducing adverse effects on the skin.

1.2. Fiber Orientation

The areas with various content of the longitudinally oriented fibers, which are the fibers 101 oriented in a longitudinal direction, i.e., a machine direction, are formed in the nonwoven fabric 110 as shown in FIGS. 2A, 2B and 3. Examples of the areas with various content include groove portions 1, side portion 8 that are included in the convex portions 2 and center portions 9.

The first direction is a longitudinal direction, that is, a machine direction and the second directions is a width direction, which is a cross direction according to the first embodiment.

When the fibers 101 are oriented at angles in the range of +45° and −45° relative to the longitudinal direction (machine direction), the fibers 101 are said to be oriented in the longitudinal direction (machine direction), and the fibers oriented in the longitudinal direction are called "longitudinally oriented fibers". When the fibers 101 are oriented at angles in the range of +45° and −45° relative to the width direction, the fibers 101 are said to be oriented in the width (lateral) direction, and the fibers oriented in the width direction are called laterally oriented fibers.

The side portions 8 are side areas of the convex portions 2 and the fibers 101 in the side portions 8 are formed in a way so that the content of the longitudinally oriented fibers becomes higher than the content of the longitudinally oriented fibers in the center portions 9, which are the areas sandwiched between the side portions 8 of convex portions 2. For example, the content of the longitudinally oriented fibers in the side portions 8 is 55% to 100% and preferably 60% to 100%. When the content of the longitudinally oriented fibers in the side portions 8 is less than 55%, the side portions 8 may be stretched by laterally applied tension. This extension of the side portions 8 may further cause extension of the groove portions 1 or the center portions 9 described below by the laterally applied tension.

The center portions 9 are areas sandwiched between side portions 8, which are the side areas of the convex portions 2, and the content of the longitudinally oriented fibers is less than that of side portions 8. It is preferable for the center portions 9 to contain an appropriate mixture of longitudinally oriented fibers and laterally oriented fibers.

For example, the center portions 9 are formed so that the content of the longitudinally oriented fibers in the center portions 9 is at least 10% less than the content in the side portions 8, and at least 10% greater than the content of the longitudinally oriented fibers in the base of the groove portions 1 described later. Specifically, the content of the longitudinally oriented fibers in the center portions 9 are preferably in the range of 40% to 80%.

Since the groove portions 1 are the areas where fluids, consisting mainly of gaseous matter (hot air, for example), are jetted directly as described above, the longitudinally oriented fibers in the groove portions 1 are jetted and gathered to the side portions 8. The laterally oriented fibers in the groove portions 1 are left in the base of groove portions 1. The content of the laterally oriented fibers in the fibers 101 in the base of the groove portions 1 becomes greater than the content of the longitudinally oriented fibers.

For example, the content of the longitudinally oriented fibers in the groove portions 1 is at least 10% less than the content of the longitudinally oriented fibers in the center portions 9. Therefore, the content of the longitudinally oriented fibers in the base of the groove portions 1 is the least in the nonwoven fabric 110 whereas the content of the laterally oriented fibers is the greatest. Specifically, the content of the longitudinally oriented fibers is from 0% to 45% and preferably from 0% to 40%. When the content of the longitudinally oriented fibers is greater than 45%, increasing the strength of the nonwoven fabric in the width direction becomes difficult because of low fiber weight in the groove portions 1 as described later. For example, when the nonwoven fabric 110 is used as a surface sheet of absorbent products, the absorbent products may be twisted in the width direction or damaged due to friction against human body during use.

The measurement of the fiber orientation was performed by the measurement method described below using a digital microscope VHX-100 by Keyence Corporation. (1) A sample is set on the observation table in a way so that the longitudinal direction is in the machine direction. (2) Fibers irregularly protruding in front are removed and the lens is focused on the nearest front fiber of the sample. (3) Depth is set and a 3D image of the sample is created on the computer screen. Next, (4) the 3D image is converted to a 2D image. (5) A number of parallel lines are drawn on the screen equally dividing the longer direction in the measurement range into a number of cells. (6) Fiber orientation in each cell is observed and determined if it is in the longer direction or the width direction and the number of fibers oriented in each direction is measured. (7) The ratio of the number of fibers oriented in the longer direction and the ratio of number of fibers oriented in the width direction are calculated relative to the total number of fibers within the measurement range, thereby determining the fiber orientation.

1.3. Fiber Sparsity and Density

As shown in FIGS. 2A, 2B and 3, the groove portions 1 are adjusted so as to have a lower fiber density of the fiber 101 than that of convex portions 2. Moreover, the fiber density of the groove portions 1 can be optionally adjusted depending on the various conditions such as amount of fluids, consisting mainly of gaseous matter (hot air, for example), or tension applied to the nonwoven fabric 110. The fiber density of the convex portions 2 are set to be greater than the fiber density of the groove portions 1.

Specifically, the fiber density in the base of the groove portions 1 is no greater than 0.18 g/cm$^3$, preferably 0.002 g/cm$^3$ to 0.18 g/cm$^3$ and more preferably 0.005 g/cm$^3$ to 0.05 g/cm$^3$, for example. When the fiber density in the base of the groove portions 1 is less than 0.002 g/cm$^3$, the nonwoven fabric 110 may be easily damaged while being used for absorbent products, for example. When the fiber density in the base of the groove portions 1 is greater than 0.18 g/cm$^3$, liquids become less likely to be transferred downwards and are collected in the base of the groove portions 1, possibly causing the user to experience a wet feeling.

The fiber density of the fiber 101 in the convex portions 2 is adjusted to be greater than the groove portions 1. The fiber density of the concave portions 2 can be optionally adjusted depending on the various conditions such as amount of fluids, consisting mainly of gaseous matter (hot air, for example), or tension applied to the nonwoven fabric 110.

Specifically, the fiber density of the convex portions 2 is no greater than 0.20 g/cm$^3$, preferably 0.005 g/cm$^3$ to 0.20 g/cm$^3$ and more preferably 0.007 g/cm$^3$ to 0.07 g/cm$^3$, for example. When the fiber density of the convex portions 2 is less than 0.005 g/cm$^3$, not only the convex portions 2 are likely to be crushed by the weight of the liquid contained therein or external pressure, but the liquid once absorbed may reverse its course under the additional pressure. When the fiber density of the convex portions 2 is greater than 0.20 g/cm$^3$, the predefined liquid fed into the convex portions 2 becomes less likely to be transferred downwards and is collected in the convex portions 2, possibly causing the user to experience a wet feeling.

Specifically, the fiber density of the center portions 9 in the convex portions 2 is 0 g/cm$^3$ to 0.20 g/cm$^3$, preferably 0.005 g/cm$^3$ to 0.20 g/cm$^3$ and more preferably 0.007 g/cm$^3$ to 0.07 g/cm$^3$, for example. When the fiber density of the center portions 9 is less than 0.005 g/cm$^3$, not only the center portions 9 is likely to be crushed by weight of the liquid contained therein or by external pressure, but the liquid once absorbed may reverse its course under the additional pressure. When the fiber density of the center portions 9 is greater than 0.20 g/cm$^3$, the liquid contained in the center portions 9 becomes less likely to be transferred downwards and is collected in the center portions 9, possibly causing the user to experience a wet feeling.

The fiber density of the side portions 8, which are the sides of the convex portions 2, can be optionally adjusted depending on the various conditions such as amount of fluids, consisting mainly of gaseous matter (hot air, for example), or tension applied to the nonwoven fabric 110. Specifically, the fiber density of the side portions 8 is 0 g/cm$^3$ to 0.40 g/cm$^3$, preferably 0.007 g/cm$^3$ to 0.25 g/cm$^3$ and more preferably 0.01 g/cm$^3$ to 0.20 g/cm$^3$, for example. When the fiber density of the side portions 8 is less than 0.007 g/cm$^3$, the side portions 8 may be stretched due to laterally applied tension. When the fiber density of the side portions 8 is greater than 0.40 g/cm$^3$, the liquid contained in the side portions 8 becomes less likely to be transferred downwards and is collected in the side portions 8, possibly causing the user to experience a wet feeling.

The nonwoven fabric 110 is formed in a way so that the percent open area measured from a surface where the convex portions 2 protrude, which is a side in the thickness direction of the nonwoven fabric 110, becomes lower than the percent open area measured from opposite side of the surface where the convex portions 2 protrude, which is the other side in the thickness direction of the nonwoven fabric 110.

In the fiber web 100 conveyed on the net-like support member 210, fiber 101 is moved by gravitational force to the surface opposite the surface to which fluids, consisting mainly of gaseous matter, are jetted, and the distances between fibers in locations near the opposite surface are likely to be narrow. At the same time, distances between fibers are likely to become wider as the surface, to which fluids consisting mainly of gaseous matter are jetted, is approached.

The fluid, consisting mainly of gaseous matter, is further jetted to the fiber 101 near the net-like support member 210, pushing the fiber 101 against the net-like support member 210 and orientating the fiber 101 in a direction parallel with the net-like support member 210. Additionally, the distances between the fibers narrows and the fibers are more likely to be closely packed. If heating is performed in this condition, the fibers become heat-sealed thereby decreasing the degree of freedom of the fibers 101 and lowering the percent open area between the fibers.

On the other hand, as the fluids, consisting mainly of gaseous matter, approach from a surface of the net-like support member 210 of the injected side, fibers are not crushed excessively, and the fibers 101 are partially orientated so as to be vertical to the net-like support member 210 because of the jetted fluids, consisting mainly of gaseous matter, hitting the net-like support member 210 and bouncing back in the convex portions. If the fibers are heat-sealed to each other in the above condition, degree of freedom of the fibers 101 in convex portions 2 to which the fluids, consisting mainly of gaseous matter, is jetted is increased and the percent open area between the fibers is increased.

Meanwhile, percent open area is a percentage of open area where fibers do not exist relative to the total unit area. The measurement method of percent open area is as follow.

The measurement was performed by means of the digital microscope VHX-100 by Keyence Corporation. First, (1) a sample is set on the observation table of the measurement device in a way so that the directions along the groove portions 1 and convex portions 2 are in the longitudinal direction. (2) Measurements are performed at the top of the convex portions 2 from a surface where the convex portions 2 protrude and the surface opposite the surface where the convex portions 2 protrude.

(3) Magnification level of the lens in the measurement device and on the computer screen are set appropriately, and the lens is focused on the nearest front fiber of the sample (excluding the irregular protruding fibers). (4) The depth is set appropriately to form a 3D image of the sample.

(5) The 3D image is converted into a 2D image, and the set volume is converted into two dimensions to identify the open area between fibers within that range. Furthermore, (6) the 2D image is binarized (made a segmentation) and colors of places where fibers exist are converted into white, and the places where fibers do not exist are converted into black. And (7) colors are then inverted and the places where fibers do not exist are turned to white and the areas, etc. of the whitened places are measured.

In this measurement, magnification was set at 300 times, depth was set at 220 μm (a photograph was taken once every 20 μm, a total of 11 times) and measured at n=10 and average values were determined.

The percent open area is calculated as follow.

$$\text{Percent open area (\%)} = (\text{total of open area (mm}^2)/\text{measured area (mm}^2)) \times 100$$

Total area was calculated by dividing the total area at measurement by the enlargement magnification at measurement, and the area of measurement range is calculated by dividing the area of measurement range during measurement by the expansion magnification at measurement.

As the percent open area increases, distances between fibers also increase and the fabric takes on a more a coarse texture, and the fibers easily move with a high degree of freedom. Since the nonwoven fabric in which distances between fibers are increased by having some openings has a large percent open area per single unit area, the distances between fibers in entire surface of the nonwoven fabric to which fluids, consisting mainly of gaseous matter, are jetted are wide. For this reason, when the nonwoven fabric is used for absorbent products, for example, resistance against the predefined liquid, such as excretory substance, when permeating through the nonwoven fabric 110 can be lowered entirely, thereby enabling the liquid to be easily transferred to an absorber.

The open area per single unit area is a percentage of total area of open area where no fibers exist relative to the number of open areas between the places that fibers exist within a predefined range. This can be calculated with the following formula.

$$\text{Open area } (mm^2/\text{number}) = (\text{total of open area } (mm^2)/\text{number of open area})$$

The difference between the percent open area measured from surfaces of the convex portions 2 where the convex portions 2 protrude and the percent open area measured from the surface opposite the surface where the convex portions 2 protrude is no less than 5%, preferably 5% to 80% and more preferably 15% to 40%, for example.

Moreover, the percent open area measured from the surface where the convex portions 2 protrude is no less than 50%, preferably 50% to 90% and more preferably 50% to 80%, for example.

Furthermore, the open area per single unit area measured from the surface where the convex portions 2 protrude is no less than 3,000 $\mu m^2$, preferably 3,000 $\mu m^2$ to 30,000 $\mu m^2$ and more preferably 5,000 $\mu m^2$ to 20,000 $\mu m^2$, for example.

1.4. Weight

Specifically, the average weight of entire nonwoven fabric 110 is 10 $g/m^2$ to 200 $g/m^2$ and preferably 20 $g/m^2$ to 100 $g/m^2$, for example. If the nonwoven fabric 110 is used as a surface sheet of absorbent products, for example, and when the average fiber weight is less than 10 $g/m^2$, the surface sheet may be easily damaged during use. Moreover, when the average fiber weight of the nonwoven fabric 110 is more than 200 $g/m^2$, absorbed liquid may not be transferred downward smoothly.

As shown in FIGS. 2A, 2B and 3, groove portions 1 are adjusted so as to have lower weight of the fibers 101 as compared to that of the convex portions 2. The weight of the groove portions 1 is adjusted to be less than the entire average weight including grove portions 1 and convex portions 2. Specifically, the weight in the base of the groove portions 1 is 3 $g/m^2$ to 150 $g/m^2$ and preferably 5 $g/m^2$ to 80 $g/m^2$, for example. When the weight in the base of the groove portions 1 is less than 3 $g/m^2$, and if the nonwoven fabric is used as a surface sheet of absorbent products, the surface sheet may be easily damaged during use of the absorbent products. When the weight in the base of the groove portions 1 is more than 150 $g/m^2$, the liquid fed into the groove portions 1 becomes unlikely to be transferred downward and collected in the groove portions 1, possibly causing the user to experience a wet feeling.

The convex portions 2 are adjusted so as to have a greater average weight of the fibers 101 as compared to that of the groove portions 1. The fiber weight of the center portions 9 in the convex portions 2 is 15 $g/m^2$ to 250 g/m and preferably 20 $g/m^2$ to 120 $g/m^2$, for example. When the fiber weight of the center portions 9 is less than 15 $g/m^2$, not only the center portions 9 are likely to be crushed by weight of the liquid contained therein or external pressure, but the liquid once absorbed may be likely to reverse its course under additional pressure. When the fiber weight of the center portions 9 is more than 250 $g/m^2$, the absorbed liquid becomes less likely to be transferred downward and is collected in the center portions 9, possibly causing the user to experience a wet feeling.

The weight of the side portions 8, which are the sides of the convex portions 2, can be optionally adjusted depending on various conditions such as amount of fluids, consisting mainly of gaseous matter (hot air, for example), or tension applied to the nonwoven fabric 110. Specifically, the weight of side portions 8 is 20 $g/m^2$ to 280 $g/m^2$ and preferably 25 $g/m^2$ to 150 $g/m^2$, for example. When the weight of the side portions 8 is less than 20 $g/m^2$, the side portions 8 may be stretched due to laterally applied tension. When the weight of the side portions 8 is more than 280 $g/m^2$, the liquid contained in the side portions 8 becomes less likely to be transferred downward and is collected in the side portions 8, possibly causing the user to experience a wet feeling.

The weight in the base of groove portions 1 is adjusted to be less than the average weight of entire convex portions 2 containing side portions 8 and center portions 9. For example, weight in the base of the groove portions 1 relative to the average weight of the convex portions 2 is no greater than 90%, preferably 3% to 90% and more preferably 3% to 70%. When the weight in the base of groove portions 1 relative to the average weight of the convex portions 2 is more than 90%, resistance against the liquid contained in the groove portions 1 is increased as it is transferred downwards in the nonwoven fabric 110, and the liquid may overflow from the groove portions 1. When the weight in the base of groove portions 1 relative to the average fiber weight of the convex portions 2 is less than 3%, and if the nonwoven fabric is used as a surface sheet of absorbent products, for example, the surface sheet may be damaged easily during use of the absorbent products.

1.5. Others

When the nonwoven fabric in the first embodiment is used for absorbing or transmitting a predefined liquid, for example, it is unlikely to hold the liquid because the liquid penetrates through the groove portions 1, and the convex portions 2 have a porous structure.

The groove portions 1 are suitable for transmitting liquids because of low fiber density and low weight of the fibers 101. Furthermore, it is possible to prevent the liquid from overflowing in the longitudinal direction of the groove portions 1 and spreading broadly because the fibers 101 in the base of the groove portions 1 are oriented in the width direction. Even though the fiber density of the groove portions 1 is low, the strength of the nonwoven fabric in the width direction (CD strength) is increased as the fibers 101 are oriented in the width direction of the groove portions 1 (CD (Cross Direction) orientation).

The weight of the convex portions 2 is adjusted to be high for increasing the number of fibers to thereby increase the number of sealed points to maintain a porous structure.

The content of laterally oriented fibers per unit area in the groove portions 1 is greater than that of the center portions 9, and the content of longitudinally oriented fibers per unit area in the side portions 8 is greater than that of the center portions 9. The fibers 101 oriented in the thickness direction are contained in the center portions 9 in an amount greater than that in the groove portions 1 or side portions 8. For this reason, even if the thickness of the convex portions 2 decreases due to the load given to the center portions 9, for example, when the load is released, it is likely to resume its original height because of the rigidity of the fibers 101 oriented in the thickness direction. More specifically, it is possible to form a nonwoven fabric which has a high ability to recover from compression.

1.6. Manufacturing Method

The method for manufacturing the nonwoven fabric 110 according to the first embodiment will be explained below as shown in FIGS. 4A, 4B and 9. First, a fiber web 100 is placed on an upper surface side of a net-like support member 210 as a breathable support member. In other words, the fiber web 100 is supported from beneath by the net-like support member 210.

As shown in FIG. 5, the nonwoven fabric 110 according to the first embodiment can be manufactured by moving the net-like support member 210 supporting the fiber web 100 in a predetermined direction, and jetting a gaseous matter continuously from the upper surface side of the fiber web 100 being moved.

Weaving a number of impervious wires 211 of specific thickness forms the support member 210. A number of holes 213 are formed in the net-like support member by weaving the number of wires 211 at predefined intervals to ensure ventilation.

A number of holes 213 with a small hole diameter are formed in the net-like support member 210 as shown in FIGS. 4A and 4B, and the gaseous matter jetted from the upper surface side of the fiber web 100 is ventilated downward without being hampered by the net-like support member 210. The net-like support member 210 does not change the flow of jetted gaseous matter significantly, and the fibers 101 are not moved downward in the net-like support member.

Therefore, the fibers 101 in the fiber web 100 are moved in a specified direction by the gaseous matter jetted mainly from the upper surface side. Specifically, the fibers 101 are moved in a direction along the surface of the net-like support member 210 because downward movement in the net-like support member 210 is restricted.

For example, the fibers 101 in an area where the gaseous matter is jetted are moved to an adjacent area. And since the area where the gaseous matter is jetted moves in a specific direction, the fibers 101 are moved to each lateral area sequentially as the gaseous matter is jetted in the specific direction.

This forms the groove portions 1 while the fiber 101 in the base of the groove portions 1 is moved so as to be oriented in the width direction. Moreover, the convex portions 2 are formed between the groove portions 1, the fiber density of the sides of the convex portions 2 is increased, and the fibers 101 are oriented in the longitudinal direction.

A nonwoven fabric manufacturing apparatus 90 for manufacturing the nonwoven fabric 110 according to the first embodiment as shown in FIGS. 6 and 7 contains a breathable support member 200 which supports the fiber web 100 as a fiber aggregate from one side, an ejection unit 910 from which fluids consisting mainly of gaseous matter are jetted to one side of the fiber web 100, which is the fiber aggregate supported by the breathable support member 200 from the other side, and an air supplying unit not shown in figures.

The nonwoven fabric 110 is formed while the fiber web 100 is being conveyed sequentially by means of a conveying unit in the nonwoven fabric manufacturing apparatus 90. The conveying unit moves the fiber web 100 as a fiber aggregate while being supported from one side by the above breathable support member 200 in a specified direction. Specifically, the fiber web 100 to which the fluids, consisting mainly of gaseous matter, are being jetted is moved in the specified direction F. Examples of conveying unit include a conveyer 930 as shown in FIG. 6. The conveyer 930 contains a ring-shaped, breathable belt unit 939 on which the breathable support member 200 is disposed, and rotating units 931 and 933, which rotates the ring-shaped breathable belt unit 939, are disposed on both sides in the longitudinal direction in the horizontally long, ring-shaped breathable belt unit 939.

The breathable support member 200 can be changed appropriately depending on the nonwoven fabrics being manufactured. For example, if the nonwoven fabric 110 according to the first embodiment is manufactured, the above net-like support member 210 can be used as the breathable support member 200.

The breathable support member 200 (net-like support member 210) is moved in the specified direction F by the conveyer 930 while supporting the fiber web 100 from beneath as described above. Specifically, the fiber web 100 is conveyed through the lower side of the ejection unit 910 as shown in FIG. 6. Furthermore, the fiber web 100 is conveyed through the inside of the heater unit 950 having openings on both sides for heating units.

The ejection unit as shown in FIG. 8 contains an air supplying unit, not shown in the figures, and the ejection unit 910. The air supplying unit, not shown in figures, is connected to the ejection unit 910 through the air supplying tube 920. The air supplying tube 920 is connected breathably to an upper side of the ejection unit 910. A number of ejection holes 913 are formed in the ejection unit 910 at predefined intervals as shown in FIG. 9.

The gaseous matter supplied from the air supplying unit, not shown in figures, to the ejection unit 910 through the air supplying tube 920 is ejected from the ejection holes 913 formed in the ejection unit 910. The gaseous matter ejected from the ejection holes 913 is jetted to the upper surface side of the fiber web 100 supported from beneath by the breathable support member 200 (net-like support member 210) continuously. Specifically, the gaseous matter ejected from the ejection holes 913 is jetted to the upper surface side of the fiber web 100 while being conveyed in the specified direction F by means of the conveyer 930.

An air suction unit 915 disposed beneath the breathable support member 200 (net-like support member 210), which is beneath the ejection unit 910, evacuates the gaseous matter ejected from the ejection unit 910 and ventilated through the breathable support member 200 (net-like support member). It is also possible to position the air suction unit 915 to make the fiber web 100 stick to the breathable support member 200 (net-like support member) by suction force of the air suction unit 915.

The suction force of the air-suction unit 915 may be at a level where the fibers 101 in the area where the fluids, consisting mainly of gaseous matter, are jetted are pushed against the breathable support member 200 (net-like support member 210). The shape of the fiber web 100 can be protected from crumbling due to the fluids, consisting mainly of gaseous matter, being bounced back after hitting the impervious portion of the breathable support member 200 (the wires 211 of the net-like support member 210, for example) by suctioning the jetted fluids, consisting mainly of gaseous matter, by means of the air suction unit 915. The shapes of formed groove portions (irregularities) can be maintained while being conveyed into the heater unit 950 by air flow. In this case, it is preferable for the fiber web 100 to be conveyed to the heater unit 950 while being evacuated as well as being formed by air flow.

Since the fluid, consisting mainly of gaseous matter, is evacuated from beneath the breathable support member 200 (net-like support member 210), the fibers in the area where the fluid, consisting mainly of gaseous matter, is jetted are conveyed while being pushed against the breathable support member 200 (net-like support member 210), and the fibers are aggregated on the breathable support member 200 (net-like support member 210) side as a result. Moreover, the fibers 101 are partially oriented in the thickness direction because of the jetted fluid, consisting mainly of gaseous matter, is bounced back as it hits the impervious portion of the breathable support member 200 (the wires 211 of the net-like support member 210, for example).

The temperature of the fluid, consisting mainly of gaseous matter, jetted from each of the ejection holes 913 may be a room temperature as described above, however, in order to improve formability of the groove portions (irregularities), etc., for example, the temperature may be adjusted to at least more than the softening point of thermoplastic fibers of which the fiber aggregate consists, and the temperature is preferably in the range of +50° C. to −50° C., which are the melting points and more higher than softening points. If the fibers are softened, the shapes of the fibers being re-oriented are easily maintained by air flow, etc., because the repulsive force of the fibers themselves is lowered. If the temperature is further increased, heat sealing between the fibers begins. Therefore, the shapes of the groove portions (irregularities), etc., are more easily maintained. This makes conveying the fiber into the heater unit 950 while maintaining the shapes of the groove portions (irregularities) easier.

Meanwhile, it is possible to change shapes of the convex portions 2 by adjusting the air volume, the temperature and the amount of evacuated fluid, consisting mainly of gaseous matter, the breathability of the breathable support member 200 and the weight of the fiber web 100. For example, when the amount of jetted fluid, consisting mainly of gaseous matter, and the amount of evacuated fluid, consisting mainly of gaseous matter, are approximately equivalent, or when the amount of evacuated fluid, consisting mainly of gaseous matter, is more than the amount of injected fluid, consisting mainly of gaseous matter, the reverse side of the convex portions 2 in the nonwoven fabric 115 (nonwoven fabric 110) is formed along the shape of the breathable support member 200 (net-like support member 210). Therefore, when the breathable support member 200 (net-like support member 210) is flat, the reverse side of the nonwoven fabric 115 (nonwoven fabric 110) becomes substantially flat.

Moreover, the fiber web 100 can be conveyed into the heater unit 950 right after forming the groove portions (irregularities) by air flow, or as they are forming, or the fiber web 100 can be conveyed into the heater unit 950 after cooling by cool air, right after forming the groove portions (irregularities), by hot air (air flow at a specified temperature) while maintaining the shapes of the groove portions (irregularities), formed by air flow.

The heater unit 950 as a heating unit has openings on both sides in a specified direction F. Through these openings, the fiber web 100 (nonwoven fabric 110) placed on the breathable support member 200 (net-like support member 210) conveyed by the conveyer 930 is continuously moved while staying in the heated space formed within the heater unit 950 for a predetermined time. For example, when thermoplastic fibers are contained in the fibers 101 of which the fiber web 100 consists, (nonwoven fabric 110), a nonwoven fabric 115 (nonwoven fabric 110) in which fibers 101 are bonded by heat in the heating unit 950 can be obtained.

2. Other Embodiments

The nonwoven fabric of the present invention according to other embodiments will be explained below. The features similar to the nonwoven fabric according to the first embodiment are not particularly explained in the embodiments below, and numbers given to figures are the same as described in the first embodiment if this is the case.

The nonwoven fabric of the present invention according to the second to seventh embodiments will be explained referring to FIGS. 10 to 18. The second embodiment relates to the shape of the nonwoven fabric. The third embodiment relates to the shape of the nonwoven fabric. The fourth embodiment relates a surface opposite the surface on which convex portions and groove portions are formed in the nonwoven fabric. The fifth embodiment relates to convex portions in the nonwoven fabric. The sixth embodiment relates to openings in the nonwoven fabric. The seventh embodiment relates to groove portions in the nonwoven fabric.

2.1. Second Embodiment

The nonwoven fabric of the present invention according to the second embodiment will be explained referring to FIG. 10.

2.1.1. Shape

The nonwoven fabric 114 according to the second embodiment is a nonwoven fabric having substantially flat surfaces on both sides as shown in FIG. 10. And areas of different fiber orientation are formed in predefined areas in the nonwoven fabric. The explanation below will focus on points which differ from the first embodiment.

2.1.2. Fiber Orientation

A number of areas which differ in the content of longitudinally oriented fibers are formed in the nonwoven fabric 114 as shown in FIG. 10. Examples of the areas which differ in the content of longitudinally oriented fibers include longitudinally oriented portions 13 where the content of the longitudinally oriented fibers is the greatest in the nonwoven fabric 114, center portions 12 where the content of the longitudinally oriented fibers is less than that of the longitudinally oriented portion 13, and laterally oriented fibers 11 where the content of the longitudinally oriented fibers is the least and the content of the laterally oriented fibers is the greatest. A number of longitudinally oriented portions 13 are formed along both side of the laterally oriented portions 11 in the nonwoven fabric 114. A number of the center portions 12 are formed on the nonwoven fabric as being sandwiched in between adjacent longitudinally oriented portions 13 on opposite sides of the laterally oriented portions 11.

The laterally oriented portions 11 are formed with remaining fibers 101 after the fibers 101 oriented in a longitudinal direction as a machine direction of the fiber web 100 are shifted to the longitudinally oriented portions 13. Since the fibers 101 oriented in the longitudinal direction are moved to the longitudinally oriented portions 13, the laterally oriented fibers oriented mainly in the width direction as the lateral direction are left in the laterally oriented portions 11. Therefore, most of the fibers 101 in the laterally oriented portions 11 are oriented in the width direction as lateral direction. Even though the laterally oriented portions 11 are adjusted so as to have lower fiber weight as described below, tensile strength in the width direction increases because most of the fibers 101 in the laterally oriented portions 11 are oriented in the width direction. This can prevent damage to the nonwoven fabric 114 even if forces such as friction are added in the width direction during use, when the nonwoven fabric 114 is used as a surface sheet of absorbent products, for example.

The longitudinally oriented portions 13 are formed as the fibers 101 oriented in the longitudinal direction in the fiber web 100 are shifted to the longitudinally oriented portions 13 by the jetted fluid, consisting mainly of gaseous matter. Since most of the fibers 101 in the longitudinally oriented portions 13 are oriented in the longitudinal direction, the distance between fibers 101 becomes less, thereby increasing the fiber density. For this reason, rigidity of the longitudinally oriented portions 13 also increases.

2.1.3. Fiber Sparsity and Density

Since the fibers 101 in the laterally oriented portions 11 are moved due to the jetted fluid, consisting mainly of gaseous matter, as shown in FIG. 10, the fibers 101 are moved so as to aggregate in the lower side of the nonwoven fabric 114 in the thickness direction by jet pressure. Therefore, the nonwoven fabric 114 has a greater value of percent open area in the upper side in the thickness direction and has a smaller value of percent open area in the lower side. In other words, fiber density of the upper side of the nonwoven fabric 114 in the thickness direction is low, whereas the fiber density of the lower side is high.

Moreover, the fiber density of the laterally oriented portions 11 is low because the fibers 101 are moved by the jetted fluid, consisting mainly of gaseous matter. The fiber density of the longitudinally oriented portions 13 is greater than that of the laterally oriented portions 11 because the fibers 101 moving from the laterally oriented portions 11 are aggregated in the longitudinally oriented portions 13. The fiber density of the center portions 12 is intermediate between the fiber density of the laterally oriented portions 11 and the fiber density of the longitudinally oriented portions 13.

2.1.4. Weight

The fiber weight of the laterally oriented portions 11 becomes the least because the fibers 101 are moved to other areas by the fluid, consisting mainly of gaseous matter, jetted to the laterally oriented portions 11. And the weight in the longitudinally oriented portions 13 becomes the greatest because the fibers 101 moving from the laterally oriented portions 11 are shifted to the longitudinally oriented portions 13. The center portions 12 are formed as being sandwiched by the longitudinally oriented portions 13 on both sides. Since the center portions 12 or the laterally oriented portions 11 which are areas with low weight are formed so that both sides are supported by the longitudinally oriented portions 13 with greater weight, they can be protected from being stretched by laterally applied tension, etc., for example, even if the weights are low.

2.1.5. Others

When the nonwoven fabric 114 is used as a surface sheet of absorbent products, for example, it can be used while maintaining the laterally oriented portions 11 or center portions 12 with low weight, that is, while not being stretched by laterally applied tension during manufacture of the products. Since highly oriented portions 13 with high weight are formed between each of the laterally oriented portions 11 or the center portions 12, the nonwoven fabric 114 is not likely to be crushed due to liquid weight or weight thereof when liquid is contained. Therefore, even if liquid is discharged repeatedly, liquid can be transferred downward in the nonwoven fabric 114 without spreading on the surface.

2.1.6. Manufacturing Method

The method for manufacturing the nonwoven fabric 114 according to the second embodiment will be explained below. First, the fiber web 100 is placed on an upper surface side of the net-like support member 210 as a breathable support member 200. In other words, the fiber web 100 is supported from beneath by the net-like support member 210. The net-like support member 210 similar to the net-like support member 210 as described in the first embodiment can be used.

The nonwoven fabric 114 according to the second embodiment can be manufactured by conveying the net-like support member 210 while it is supporting the fiber web 100 in a specified direction, and jetting fluids continuously from an upper surface side of the fiber web 100 being conveyed.

The amount of fluid, consisting mainly of gaseous matter, jetted to the nonwoven fabric 114 may be at a level where the fibers 101 of the fiber web 100 in the area where the fluid, consisting mainly of gaseous matter, is jetted can be moved in the width direction. In this case, it is preferable for the jetted fluid, consisting mainly of gaseous matter, not to be evacuated by the air suction unit 915 which pulls the fluid to the lower side of the net-like support member 210, however, it may be evacuated as long as the laterally oriented portions 11 are not pushed against the net-like support member 210.

Moreover, the formed irregularities such as groove portions or convex portions 2 may be crushed by twisting the nonwoven fabric around rolls, etc. after forming.

As described above, the nonwoven fabric 114 having a substantially constant thickness can be formed with less force of holding down the fiber 101 to the net-like support member 210 without forming irregularities.

The nonwoven fabric 114 according to the second embodiment can be manufactured by means of a nonwoven fabric manufacturing apparatus 90. The method for manufacturing the nonwoven fabric 114 by means of the nonwoven fabric manufacturing apparatus 90 can be referred to the explanation for the method for manufacturing the nonwoven fabric 110 and the nonwoven fabric manufacturing apparatus 90 as described in the first embodiment.

2.2. Third Embodiment

The nonwoven fabric of the present invention according to the third embodiment will be explained referring to FIGS. 11 and 12.

2.2.1. Nonwoven Fabric

The nonwoven fabric 116 according to the third embodiment differs from the nonwoven fabric as described in the first embodiment in having alternate roughness so that the entire nonwoven fabric 116 is crossed in the longitudinal direction. The nonwoven fabric 116 according to the third embodiment will be explained focusing on the points differing from the first embodiment.

The nonwoven fabric 116 according to the third embodiment is formed so as for the entire nonwoven fabric 116 to be corrugated in the longitudinal direction as machine direction.

2.2.2. Manufacturing Method

The method for manufacturing the nonwoven fabric 116 according to the third embodiment is similar to the method described in the first embodiment except for the embodiment of the net-like support member 260 as a breathable support member. Weaving a number of impervious wires 261 of specific thickness forms the net-like support member 260. A number of holes 263 are formed in the net-like support member 260 by weaving the number of wires 261 at predefined intervals to ensure ventilation.

The net-like support member 260 according to the third embodiment is formed as being corrugated in the direction parallel to the axis Y as shown in FIG. 12, for example. The support member is corrugated in the direction parallel to one of the longitudinal direction or the lateral direction of the net-like support member 260.

A number of holes 263 with a small hole diameter are formed in the net-like support member 260 as shown in FIG. 12, and the fluid jetted from an upper surface side of the fiber web 100 is ventilated downward without being hampered by the net-like support member 260. The net-like support member 260 does not change the flow of the jetted fluid, consisting mainly of gaseous matter, significantly, and the fibers 101 are not moved downward in the net-like support member 260.

Because the net-like support member 260 itself has a corrugated profile, the fiber web 100 is formed having a corrugated profile conforming to the shape of the net-like support member 260 by the fluid consisting, mainly of gaseous matter, jetted from the upper surface side of the fiber web 100.

Moving the fiber web 100 along the direction of axis X while the fluid, consisting mainly of gaseous matter, is jetted to the fiber web 100 placed on the upper surface of the net-like support member 260 can form the nonwoven fabric 116.

The mode of corrugated shape of the net-like support member 260 may be arbitrarily set. For example, the pitch between the tops of the corrugated shape in the X direction as shown in FIG. 12 is 1 mm to 30 mm and preferably 3 mm to 10 mm. Moreover, the difference between the top and the bottom of the corrugated shape of the net-like support member 260 is 0.5 mm to 20 mm and preferably 3 mm to 10 mm, for example. The cross sectional shape of the net-like support member 260 in the X direction is not only limited to corrugated profile as shown in FIG. 12, and may be substantially triangular in a continuous fashion with sharply-angled top and bottom points or having substantially quadrangular irregularities with substantially flat highest and lowest points.

The nonwoven fabric 116 according to the third embodiment can be manufactured by means of a nonwoven fabric manufacturing apparatus 90. The method for manufacturing the nonwoven fabric 116 by means of the nonwoven fabric manufacturing apparatus 90 can be referred to the explanation for the method for manufacturing the nonwoven fabric 110 and the nonwoven fabric manufacturing apparatus 90 as described in the first embodiment.

2.3. Fourth Embodiment

The nonwoven fabric of the present invention according to the fourth embodiment will be explained referring to FIG. 13.

The nonwoven fabric 140 according to the fourth embodiment differs from the nonwoven fabric as described in the first embodiment in a mode that the surface opposite of the surface on which the groove portions 1 and the convex portions 2 are formed in the nonwoven fabric 140 as shown in FIG. 13. The nonwoven fabric 140 according to the fourth embodiment is explained below focusing on the points different from the first embodiment.

2.3.1. Nonwoven Fabric

The groove portions 1 and the convex portions 2 are formed alternately in parallel with each other on one side of the nonwoven fabric 140 according to the fourth embodiment. The backside of the convex portions 2 protrude to the side in which the convex portions 2 protrude on the other side of the nonwoven fabric 140. In other words, the bottoms of the convex portions 2 on one side are hollowed to form concave portions on the other side of the nonwoven fabric 140. And the bottoms of the groove portions 1 on one side protrude conversely to form convex portions.

2.3.2. Manufacturing Method

The method for manufacturing the nonwoven fabric 140 according to the fourth embodiment is similar to that described in the first embodiment. The support member similar to the net-like support member 210 as described in the first embodiment can be used for manufacturing the nonwoven fabric 140.

According to the fourth embodiment, the fiber web 100 is moved along a specified direction while the fluid, consisting mainly of gaseous matter, is jetted to the fiber web 100 placed on the net-like support member 210 and the jetted fluid, consisting mainly of gaseous matter, is evacuated from beneath the net-like support member 210. The amount of fluid, consisting mainly of gaseous matter, being evacuated is set to be less than the amount of the fluid, consisting mainly of gaseous matter, being jetted. If the amount of fluid, consisting mainly of gaseous matter, being jetted is greater than the amount of the fluid, consisting mainly of gaseous matter, being evacuated, the jetted fluid, consisting mainly of gaseous matter, hits the net-like support member 210 as a breathable support member 200 and a component is directed back and passes through the convex portions 2 from the bottom to the top. For this reason, the lower surface side (bottom) of the convex portions 2 is formed in a substantially protruded shape in the same direction as the upper surface side of the convex portions 2.

The nonwoven fabric 140 according to the fourth embodiment can be manufactured by means of the above the nonwoven fabric manufacturing apparatus 90. The method for manufacturing the nonwoven fabric 140 by means of the nonwoven fabric manufacturing apparatus 90 can be referred to the description of the method for manufacturing the nonwoven fabric 110 and the nonwoven fabric manufacturing apparatus 90 as described in the first embodiment.

2.4. Fifth Embodiment

The nonwoven fabric of the present invention according to the fifth embodiment will be explained by referring to FIG. 14.

The nonwoven fabric 150 according to the fifth embodiment differs from the nonwoven fabric as described in the first embodiment in that the second convex portions 22 having heights different than that of the convex portions 2 are formed on one side of the nonwoven fabric 150 as shown in FIG. 14. The nonwoven fabric 150 according to the fifth embodiment will be explained below focusing on the points different from the first embodiment.

2.4.1. Nonwoven Fabric

A number of groove portions 1 are formed in parallel with each other on one side of the nonwoven fabric 150 according to the fifth embodiment. A number of convex portions 2 and a number of the second convex portions 22 are formed alternately between each of the formed groove portions 1. The convex portions 2 and the second convex portions 22 are formed in parallel with each other as the groove portions 1.

The convex portions 2 and the second convex portions 22 are the areas in the fiber web 100 where the fluid, consisting mainly of gaseous matter, is not jetted, and the areas protrude reversely as the groove portions 1 are formed. For example, the height in the thickness direction of the second convex portions 22 is less and the length in the width direction is less than that of the convex portions 2. The second convex portions 22 is the same as the convex portions 2 in terms of the fiber sparsity and density, fiber orientation and weight.

The convex portions 2 and the second convex portions 22 of the nonwoven fabric 150 are formed between each of the groove portions 1 formed in parallel with each other. The convex portions 2 are formed so as to be adjacent to the second convex portions 22 across the groove portions 1. The second convex portions 22 are formed so as to be adjacent to the convex portions 2 across the groove portions 1. Specifically, they are formed in the order of the convex portions 2, the groove portions 1, the second convex portions 22, the groove portions 1 and the convex portions 2 sequentially. In other words, the convex portions 2 and the second convex portions 22 are formed alternately across the groove portions 1.

The positional relationship of the convex portions 2 and the second convex portions 22 is not limited to the above, and it is possible to form a number of convex portions 2 next to each other across the groove portions 1 at least in part of the nonwoven fabric 150. Or, a number of second convex portions 22 can be formed next to each other across the groove portions 1.

As for the fiber orientation and the fiber density of the second convex portions 22, the longitudinally oriented fibers in the groove portions 1 are shifted to the side portions 88 of the second convex portions 22 making fiber weight of the side portions 88 in the second convex portions 22 increase to a value similar to that of the convex portions 2 in the nonwoven fabric 150. Furthermore, the amount of the longitudinally oriented fibers oriented in the longitudinal direction as machine direction becomes greater than the amount of the laterally oriented fibers oriented in the width direction as lateral direction in the side portions 88. In addition, the center portions 99 sandwiched between the side portions 88 in the second convex portions 22 have a weight that is less than that of the side portions 88 and greater than that of the groove portions 1.

2.5.2. Manufacturing Method

The method for manufacturing the nonwoven fabric 150 according to the fifth embodiment is similar to that described in the first embodiment except for the embodiment of the ejection hole 913 of the nonwoven fabric manufacturing apparatus 90 used for manufacturing the nonwoven fabric 150.

The nonwoven fabric 150 is formed by moving the fiber web 100 placed on an upper surface of the net-like support member 260 in a specified direction while jetting a fluid, consisting mainly of gaseous matter. The groove portions 1, the convex portions 2 and the second convex portions 22 are formed during jetting of the fluid, consisting mainly of gaseous matter, however, these configurations can be modified by the embodiment of the ejection holes 913 for the fluid, consisting mainly of gaseous matter, in the nonwoven fabric manufacturing apparatus 90.

The nonwoven fabric 150 as shown in FIG. 14 can be formed by adjusting intervals between the ejection holes 913 from which the fluid, consisting mainly of gaseous matter, is jetted. For example, a second convex portion 22 with a height in the thickness direction being lower than that of the convex portions 2 can be formed by making the intervals between the ejection holes 913 less than the intervals between the ejection holes 913 as described in the first embodiment.

Or a second convex portion 22 with a height in the thickness direction being greater than that of the convex portions 2 can be formed by increasing the intervals between the ejection holes 913 compared to the intervals between the ejection holes 913 as described in the first embodiment.

And disposing the narrow intervals and wide intervals alternately between the ejection holes 913 forms the nonwoven fabric 150 in which the convex portions 2 and the second convex portions 22 are disposed alternately in parallel with each other across the groove portions 1. The intervals between the ejection holes 913 are not limited to the above, and it is possible to alternatively set intervals depending on the heights of the convex portions and arrangement with the second convex portions 22 in formed nonwoven fabric.

The nonwoven fabric 150 according to the fifth embodiment can be manufactured by means of the above the nonwoven fabric manufacturing apparatus 90. The method for manufacturing the nonwoven fabric 150 by means of the nonwoven fabric manufacturing apparatus 90 can be referred to the description of the method for manufacturing the nonwoven fabric 110 and the nonwoven fabric manufacturing apparatus 90 as described in the first embodiment.

2.5. Sixth Embodiment

The nonwoven fabric of the present invention according to the sixth embodiment will be explained referring to FIGS. 15 and 16.

The nonwoven fabric 160 according to the sixth embodiment as shown in FIG. 15 differs from the nonwoven fabric as described in the first embodiment in not forming groove portions and convex portions and forming a number of openings 3. The nonwoven fabric 160 according to the sixth embodiment will be explained focusing on the points differing from the first embodiment.

2.5.1. Nonwoven Fabric

A number of openings 3 are formed in the nonwoven fabric 160 according to the sixth embodiment instead of forming the groove portions and the convex portions as shown in FIG. 15.

The openings 3 are formed at approximately regular intervals along the longitudinal direction of the fiber web 100, which is the direction in which the fluid, consisting mainly of gaseous matter, is jetted to the fiber web 100 as a fiber aggregate, for example. Moreover, the openings 3 are also formed at approximately regular intervals in the width direction of the fiber web 100. The intervals at which the openings 3 are formed are not limited to the above, and the openings 3 may be formed at different intervals.

Each of the openings 3 is substantially circular or oval in shape. And the fibers 101 in each of the openings 3 are oriented along peripheries of the openings 3. Stated differently, the edges of the openings 3 in the longitudinal direction are oriented in the width direction, and the sides of the openings 3 in the longitudinal direction are oriented in the longitudinal direction.

In addition, the fiber density of the periphery of the openings 3 is adjusted to be greater than the fiber density of the other areas because the fibers 101 in the periphery of the openings 3 are moved to the periphery of the openings 3 by the jetted fluid, consisting mainly of gaseous matter.

The fiber density in the thickness direction of the nonwoven fabric 160 of the (upper) surface opposite of the surface which comes in contact with the support member 220 as shown in FIGS. 16A and 16B is less than the fiber density of the (lower) surface which comes in contact with the support member 220. This is because the fibers 101 having latitude in the fiber web 100 gathers on the support member 220 side in the fiber web 100 by gravitational force or the jetted fluid, consisting mainly of gaseous matter.

2.5.2. Manufacturing Method

The method for manufacturing nonwoven fabric 160 according to the sixth embodiment is similar to the method for manufacturing as described in the first embodiment except for not forming groove portions and convex portions. The method for manufacturing the nonwoven fabric 160 according to the sixth embodiment will be explained below focusing on the points differing from the first embodiment.

The support member 220 as shown in FIG. 16 may exemplify the support member 220 as a breathable support member 200 for forming the nonwoven fabric 160 as shown in FIG. 15. More specifically, a number of slender members 225 are disposed substantially in parallel with each other at predefined intervals on the upper surface of the net-like support member 210 as shown in FIG. 4. The slender members 225 are impervious members, and the fluid, consisting mainly of gaseous matter, jetted from the upper side is not ventilated downward. The flow direction of the fluid, consisting mainly of gaseous matter, jetted to the slender members 225 is then changed.

The nonwoven fabric 160 can be manufactured by placing the fiber web 100 on the support member 220, moving the support member 220 supporting the fiber web 100 in a specified direction and jetting the gaseous matter continuously from the upper surface side of the fiber web 100 being conveyed.

Specifically, the fluid, consisting mainly of gaseous matter, jetted continuously so that forms openings 3 without forming the groove portions and the convex portions as described in the first embodiment. Here, the fluid includes the jetted fluid, consisting mainly of gaseous matter and/or the jetted fluid, consisting mainly of gaseous matter, which ventilated through the fiber web 100 and changed the flow direction by the slender members 225.

The amount of fluid, consisting mainly of gaseous matter, jetted to the nonwoven fabric 160 may be approximately at the level where the fibers 101 of the fiber web 100 in the area to which the fluid, consisting mainly of gaseous matter, is jetted can be moved. In this case, the jetted fluid consisting, mainly of gaseous matter, may not be evacuated by the air-suction unit 915, which pulls the jetted fluid, consisting mainly of gaseous matter, under the support member 220. If the fluid, consisting mainly of gaseous matter, is evacuated by the air-suction unit 915, the amount evacuated is preferably at the level where the fiber web 100 is not pushed (crushed) against the support member 220 for protecting the shape of the formed fiber web 100 from being disturbed by the jetted fluid, consisting mainly of gaseous matter, being directed back at the support member 220.

Moreover, formed irregularities may be crushed by twisting the nonwoven fabric around rolls, etc. after forming the nonwoven fabric with irregularities by jetting the fluid, consisting mainly of gaseous matter.

Furthermore, plates having no breathable parts may be used as support members in other method for manufacturing. Specifically, placing the fiber web 100 on a plate, and jetting the fluid, consisting mainly of gaseous matter, intermittently while the support member supporting the fiber web 100 is being moved in a specified direction can manufacture the nonwoven fabric 160.

Because the plates are entirely impervious, the fluid, consisting mainly of gaseous matter, being jetted intermittently forms the openings 3 together with the fluid, consisting mainly of gaseous matter, with the flow direction being changed. Stated differently, the openings 3 are formed in the areas where the fluid, consisting mainly of gaseous matter, is jetted.

The nonwoven fabric 160 according to the sixth embodiment can be manufactured by the above nonwoven fabric manufacturing apparatus 90. The method for manufacturing the nonwoven fabric 160 by means of the nonwoven fabric manufacturing apparatus 90 can be referred to the explanation for the method for manufacturing the nonwoven fabric 110 and the nonwoven fabric manufacturing apparatus 90 as described in the first embodiment.

2.6. Seventh Embodiment

The nonwoven fabric of the present invention according to the seventh embodiment will be explained by referring to FIGS. 17 and 18.

The nonwoven fabric 170 according to the seventh embodiment as shown in FIGS. 17 and 18 differs from the nonwoven fabric as described in the first embodiment in forming hollowed portions 3A and protruded portions 4A in the groove portions 1 formed on one side of the nonwoven fabric 170. The nonwoven fabric 170 according to the seventh embodiment will be explained focusing on the points differing from the first embodiment.

2.6.1. Nonwoven Fabric

A number of groove portions 1 are formed in parallel with each other at approximately regular intervals on one side of the nonwoven fabric 170 according to the seventh embodiment as shown in FIG. 17. And each of the convex portions 2 are formed between each of the groove portions 1. Furthermore, a number of hollowed portions 3A, which are scarce areas where the fiber density is less than the groove portions 1, are formed at approximately regular intervals, and each of the protruded portions 4A, which are areas other than the scarce areas, are formed between each of the hollowed portions 3A.

The hollowed portions 3A are formed at approximately regular intervals according to the seventh embodiment; however, the hollowed portions 3A may be formed at different intervals. Although the hollowed portions 3A as shown in FIG. 17 indicate openings, it differs depending on the amount, intensity and evacuated amount of the jetted fluid, consisting mainly of gaseous matter.

The height of the hollowed portions 3 in the thickness direction of the nonwoven fabric 170 is no greater than 90%, preferably 0% to 50% and more preferably 0% to 20% of the height of the protruded portions 4A in the thickness direction of the nonwoven fabric, for example. The height of 0% indicates that the hollowed portions 3A are openings.

Both of the lengths of one hollowed portion 3A in the longitudinal direction and the width direction are 0.1 mm to 30 mm and preferably 0.5 mm to 10 mm, for example. The pitch between adjacent hollowed portions 3A across the protruded portion 4A is 0.5 mm to 30 mm and preferably 1 mm to 10 mm, for example.

The height of the protruded portion 4A in the thickness direction of the nonwoven fabric 170 is no greater than the height of the convex portions 2 in the thickness direction of the nonwoven fabric 170, preferably 20% to 100% and more preferably 40% to 70% of the height of the convex portions 2 in the thickness direction of the nonwoven fabric 170, for example.

The lengths of one protruded portion 4A in the longitudinal direction and the width direction of the nonwoven fabric 170 are 0.1 mm to 30 mm and preferably 0.5 mm to 10 mm, for example. The pitch between tops of adjacent protruded portions 4A across the hollowed portion 3A is 0.5 mm to 30 mm and preferably 1 mm to 10 mm, for example.

The cross-sectional shape of the protruded portions 4A in the longitudinal direction of the nonwoven fabric is substantially rectangular in shape. Meanwhile, cross-sectional shape of the protruded portions 4A in the longitudinal direction is not particularly limited to substantially rectangular shape and may be substantially dome, trapezoidal, triangular and Ω-like in shape. It is preferably approximately rectangular in shape in order to prevent the predefined liquid in the groove portions 1 from spreading. In addition, the top surface of the protruded portions 4A is preferably substantially flat or curved for protecting the skin from feeling foreign body sensation while in contact with the protruded portions 4A under excessive external pressure.

The cross sectional shape of the hollowed portions 3A in the longitudinal direction of the nonwoven fabric is not particularly limited and may be dome, trapezoidal, Ω-like and rectangular in shape, or may be inverted shapes thereof. It is preferable for the hollowed portions 3 to be openings because it can prevent the predefined liquid in the groove portions 1 from spreading even if excessive external pressure is added or the contained predefined liquid is of high viscosity.

The fibers of the adjacent protruded portions 4A across the hollowed portions 3A in the groove portions 1 are wholly oriented along the width direction of the groove portions 1.

If the hollowed portions 3A are openings, the oriented fibers are shifted to the convex portions 2 side or the laterally oriented fibers are shifted to the protruded portions 4A side by the jetted fluid, consisting mainly of gaseous matter, in the openings. Therefore, the fibers 101 in the periphery of the openings are oriented as enclosing the periphery of the openings. This makes openings unlikely to be crushed and blocked even if external pressure, etc. is added.

The fiber density of the formed protruded portions 4A in the groove portions 1 is greater than that of the hollowed portions 3A in the groove portions 1.

The fiber densities of the hollowed portions 3A and the protruded portions 4A may be alternatively adjusted depending on various conditions such as the amount of fluid, consisting mainly of gaseous matter, or tension applied to the nonwoven fabric 110, similar to that of the convex portions 2 and the groove portions 1 as described in the first embodiment. The hollowed portions 3 may not be openings.

The fiber density of the hollowed portions 3A is no greater than 0.20 g/cm$^3$ and preferably 0.0 g/cm$^3$ to 0.10 g/cm$^3$, for example. The fiber density of 0.0 g/cm$^3$ indicates that the hollowed portions 3A are openings. When the fiber density is more than 0.20 g/cm$^3$, the predefined liquid fed into the groove portions 1 is collected in the hollowed portions 3A.

When the nonwoven fabric 170 is used as a surface sheet of absorbent products, for example, and users change their positions, etc. while the predefined liquid is collected in the hollowed portions 3A, the predefined liquid overflows easily from the hollowed portions 3A and spread into the groove portions 1, and may further spread into the surface of the nonwoven fabric 170, marking the skin.

Moreover, the fiber density of the protruded portions 4A is no greater than 0.20 g/cm$^3$, preferably 0.005 g/cm$^3$ to 0.20 g/cm$^3$ and more preferably 0.007 g/cm$^3$ to 0.10 g/cm$^3$, for example. When the fiber density of the protruded portions 4A is less than 0.005 g/cm$^3$, and if the convex portions 2 are crushed under excessive external pressure, the protruded portions 4A are also crushed and the spaces being formed by the hollowed portions 3A in the groove portions 1 may not be maintained.

When the fiber density of the protruded portions 4A is more than 0.20 g/cm$^3$, the predefined liquid fed into the groove portions 1 is collected in the protruded portions 4A, and if the nonwoven fabric 170 comes in direct contact with the skin under excessive external pressure, users may feel wet.

The weight of the fibers 101 in formed hollowed portions 3A in the groove portions 1 is less than that of the convex portions 2 and the protruded portions 4A. The weight of the formed hollowed portions 3A is the least in the nonwoven fabric 170.

The weight of the hollowed portions 3A is 0 g/m$^2$ to 100 g/m$^2$ and preferably 0 g/m$^2$ to 50 g/m$^2$, for example. The weight of the hollowed portions 3A of 0 g/m$^2$ indicates that the hollowed portions 3A are openings. When the weight of the hollowed portions 3A is more than 100 g/m$^2$, the predefined liquid fed into the groove portions 1 is collected in the hollowed portions 3A.

When the nonwoven fabric 170 is used as a surface sheet of absorbent products, for example, and users change their positions, etc. while the predefined liquid is collected in the hollowed portions 3A, the predefined liquid overflows easily from the hollowed portions 3A and spread into the groove portions 1, and may further spread into the surface of the nonwoven fabric 170, marking the skin.

The weight of the fibers 101 formed in protruded portions 4A in the groove portions 1 is greater than that of the hollowed portions 3A. The weight of the protruded portions 4A is 5 g/m$^2$ to 200 g/m$^2$ and preferably 10 g/m$^2$ to 100 g/m$^2$, for example. When the weight of the protruded portions 4A is less than 5 g/m$^2$, and if the convex portions 2 are crushed under excessive external pressure, the protruded portions 4A are also crushed and the spaces being formed by the hollowed portions 3A in the groove portions 1 may not be maintained.

Moreover, when the weight of the protruded portions 4A is more than 200 g m$^2$, the predefined liquid fed into the groove portions 1 is collected in the protruded portions 4A, and if the nonwoven fabric 170 comes in direct contact with the skin under excessive external pressure, users may feel wet.

2.6.2. Manufacturing Method

The method for manufacturing the nonwoven fabric 170 will be explained below. First, the fiber web 100 is placed on an upper surface side of the support member 270 as breathable support member as shown in FIG. 18 as described in the first embodiment. Stated differently, the fiber web 100 is supported by the support member 270 from beneath.

The fiber web 100 is moved in a specified direction while being supported by the support member 270. The nonwoven fabric 170 is manufactured by further jetting the fluid, consisting mainly of gaseous matter, from the upper surface side of the fiber web being moved.

The support member 270 is a spirally woven breathable net formed by spirally twisting wires 272 of a predefined thickness alternately around the wires 271 of a predefined thickness placed in almost parallel with each other as bridging between the wires 271.

The wires 271 and the wires 272 become impervious parts in the support member 270. Moreover, the areas surrounded by the wires 271 and the wires 272 in the support member 270 become holes 273 which are breathable parts.

The ventilation rate of this kind of support member 270 can be changed partially by partially changing the weaving method or width or shape of the threads. For example, a support member 270 spirally woven using circular stainless steel threads as wires 271 and flat stainless steel threads as wires 272 can be used.

The fluid, consisting mainly of gaseous matter, may be partially ventilated through the spaces between twisted wires (two wires, for example) that are making up impervious parts of the wires 271 and 272.

In this case, the ventilation rate of the impervious wires is no greater than 90%, preferably 0% to 50% and more preferably 0% to 20% relative to the ventilation rate of the holes 273 as ventilation units. The ventilation rate of 0% indicates that the fluid consisting mainly of gaseous matter cannot be ventilated.

The ventilation rate in the areas such as holes 273 as ventilation units is 10,000 cc/cm$^2$ ·min to 60,000 cc/cm$^2$·min and preferably-20,000 cc/cm$^2$·min to 50,000 cc/cm$^2$·min, for example. When a metallic plate is hollowed out, for example, to form a ventilation unit as other breathable support member, however, the ventilation rate may be more than the above value because resistance of the fluid, consisting mainly of gaseous matter, against the plate disappears.

The impervious areas in the support member have preferably better surface slippage than that of the areas forming ventilation units. If the surface slippage of the impervious areas is better, the fibers 101 are likely to move in the crossed points of the areas to which the fluid, consisting mainly of gaseous matter, is jetted and the impervious parts, thereby improving formability of the hollowed portions 3A and the protruded portions 4A.

When the fluid, consisting mainly of gaseous matter, is jetted to the fiber web 100 supported by the support member 270, the areas where the fluid, consisting mainly of gaseous matter, is jetted become the groove portions 1 and reversely, protruded portions become the convex portions 2 as the groove portions 1 are formed. The forming of the groove portions 1 and the convex portions 2 are as described in the first embodiment.

In addition, when the fluid, consisting mainly of gaseous matter, is jetted to the points where the wires 271 and the wires 272 of the support member 270 cross with each other in the groove portions 1, the fluid, consisting mainly of gaseous matter, is directed back at the crossed points. And the fibers 101 supported in the crossed points are shifted to the surrounding area to form hollowed portions 3A.

The groove portions 1 are formed in the upper areas of the holes 273 of the support member 270 by jetting the fluid, consisting mainly of gaseous matter, and the protruded portions 4A which are protruded conversely are formed by forming the hollowed portions 3 in the groove portions 1.

The fibers 101 oriented in almost parallel with the groove portions 1 in the hollowed portions 3A are shifted to the convex portions 2 side, and the fibers 101 oriented in the direction perpendicular to the direction along the groove portions 1 are shifted to the protruded portions 4A side by the jetted fluid, consisting mainly of gaseous matter. For this reason, weight of the hollowed portions 3A decreases.

Meanwhile, the fibers 101 are shifted to the protruded portions 4A from the hollowed portions 3A increasing the weight of the protruded portions 4A compared to that of the hollowed portions 3A.

As the other method for manufacturing the nonwoven fabric, a nonwoven fabric on which the groove portions 1 and the convex portions 2 are formed is manufactured first as described in the first embodiment, and the nonwoven fabric 170 is then manufactured by forming hollowed portions 3A and the protruded portions 4A by embossing the groove portions 1. In this case, the relationships between the hollowed portions 3A and the protruded portions 4A in terms of fiber density or weight may be opposite to the relationships described in the seventh embodiment. More specifically, the fiber density or weight of the protruded portions 4A may be less than the fiber density or weight of the hollowed portions 3A.

As the other method for manufacturing the nonwoven fabric 170, irregularities such as convex portions 2 or groove portions 1 are formed on the fiber web 100 in advance, and the fluid, consisting mainly of gaseous matter, may be jetted to where the other movable fiber webs are lapped over the fiber web 100. The convex portions and the groove portions are formed in the upper layer of the fiber webs by the jetted fluid, consisting mainly of gaseous matter, whereas the protruded portions and the hollowed portions according to the seventh embodiment are formed because irregularities formed by fiber webs of lower layers are exposed due to low weight of the groove portions. The fiber webs in the upper and the lower layers are then combined by heat treatment.

The nonwoven fabric 170 according to the seventh embodiment can be manufactured by means of the above nonwoven fabric manufacturing apparatus 90. The method for manufacturing the nonwoven fabric 170 by means of the nonwoven fabric manufacturing apparatus 90 can be referred to the description for explaining the method for manufacturing the nonwoven fabric 110 and the nonwoven fabric manufacturing apparatus 90 as described in the first embodiment.

3. EXAMPLES

3.1. Example 1

Fiber Structure

A blended cotton containing a fiber A coated with hydrophilic and lipophilic agent having a core-in-sheath structure of low-density polyethylene (melting point: 110° C.) and polyethylene terephthalate, an average fineness of 3.3 dtex and an average fiber length of 51 mm, and a fiber B, which is different from fiber A in the point that being coated with water and oil repellent agent having a core-in-sheath structure of high-density polyethylene (melting point: 135° C.) and polyethylene terephthalate are used. The mixing ratio of the fiber A and the fiber B is 70:30, and a fiber aggregate with adjusted weight of 40 g/m$^2$ is used.

The flexibility of the nonwoven fabric is increased by the difference in strength of cross points of fibers caused by the difference between the melting points of the sheath component in the fibers A and the fibers B. Specifically, if the temperature of the oven is set at 120° C., for example, the fibers are heat-sealed at cross points between fibers A or the fibers A and the fibers B because of the molten low-density polyethylene, and in addition, the strength of cross points between fibers A becomes larger than the strength of cross points between fibers B because large amount of the low-density polyethylene is melted. Moreover, heat sealing does not take place between fibers B because high-density polyethylene is not melted. Stated differently, the strength of cross points between fibers A is more than the strength of cross points between fibers A and fibers B, and the strength of cross points between fibers A and fibers B is greater than the strength of cross points between fibers B.

Manufacture Condition

A number of ejection holes 913 having a diameter of 1.0 mm are formed at a pitch of 6.0 mm as shown in FIG. 9. The shape of the ejection holes 913 is circle, and the ejections holes 913 is cylindrical shape. The width of the ejection unit 910 is 500 mm. Hot air is jetted at a temperature of 105° C. and an air volume of 1,200 L/min.

The above fiber structure is then opened by means of a card apparatus at a speed of 20 m/min to form fiber webs and the fiber webs are cut to give each fiber web a width of 450 mm. The fiber webs are conveyed onto a breathable net of 20 mesh at a speed of 3 m/min. Moreover, hot air is jetted to the fiber webs at a manufacture condition of above ejection unit 910 and the ejection holes 913 while suctioning the hot air from beneath the breathable net in the volume less than the hot air jetted. Afterward, the fiber webs are conveyed on the breathable net through inside an oven set at a temperature of 125° C. and a hot air volume of 10 Hz for approximately 30 seconds.

Result

Convex portions: 51 g/m$^2$ weight, 3.4 mm thickness (2.3 mm thickness at the top), 0.03 g/cm$^3$ fiber density, 4.6 mm width per convex portion, 5.9 mm pitch.

Groove portions: 24 g/m$^2$ weight, 1.7 mm thickness, 0.01 g/cm$^3$ fiber density, 1.2 mm width per groove portion, 5.8 mm pitch.

Value of percent open area between fibers: 69% measured from the convex portion side and 51% measured from the surface opposite the surface where the convex portions protrude.

Open area per single unit area between fibers: 8,239 μm per single unit area measured from the surface where the convex portions protrude and 1,787 $\mu m^2$ per single unit area measured from the surface opposite the surface where the convex portions protrude.

Shape: The reverse side of the groove portions becomes the most reverse surface of the nonwoven fabric, and the shape of the reverse surface of the convex portions protrude in the same direction as the convex portions not forming the most reverse side of the nonwoven fabric. In addition, the convex portions are formed as having substantially dome shape, and the convex portions and the groove portions are formed sequentially so as to be extending along the longitudinal direction. The convex portions and the groove portions are formed alternately in the width direction. Furthermore, the outermost surfaces of the convex portions are formed in a way so that the strength of cross points between fibers differs partially, and the fiber density becomes the least when compared to the fiber density of the nonwoven fabric formed in other examples which will be explained later.

3.2. Example 2

Fiber Structure

The fiber structure is as similar to that described in Example 1.

Manufacture Condition

The fiber webs of the above-mentioned fiber structure are placed on a breathable net and conveyed inside of an oven set at a temperature of 125° C. and a hot air volume of 10 Hz for approximately 30 seconds. Right after the fiber web is carried out from the oven (approximately after 2 seconds), hot air is jetted to the fiber webs using the above-mentioned ejection unit 910 and the ejection holes 913 at a temperature of 120° C. and an air volume of 2,200 L/min.

Result

Convex portions: 34 g/$m^2$ weight, 2.8 mm thickness (2.3 mm thickness at the top), 0.04 g/$cm^3$ fiber density, 4.0 mm width per convex portion, 6.1 mm pitch.

Groove portions: 21 g/$m^2$ weight, 1.1 mm thickness, 0.02 g/$cm^3$ fiber density, 2.1 mm width per groove portion, 6.1 mm pitch.

Percent open area between fibers: 62% measured from the convex portion side and 48% measured from the surface opposite of the surface where the convex portions protrude.

Open area per single unit area between fibers: 7,239 $\mu m^2$ per single unit area measured from the surface where the convex portions protrude and 1,221 $\mu m^2$ per single unit area measured from the surface opposite of the surface where the convex portions protrude.

Shape: The convex portions and the groove portions are formed.

3.3. Example 3

Fiber Structure

The fiber structure is as similar to that described in Example 1.

Manufacture Condition

Hot air is jetted to the fiber webs using the above-mentioned ejection unit 910 and ejection holes 913 at a temperature of 105° C. and an air volume of 1,000 L/min while evacuating almost the same or a slightly larger volume of the injected hot air.

Result

Convex portions: 49 g/$m^2$ weight, 3.5 mm thickness, 0.02 g/$cm^3$ fiber density, 4.7 mm width per convex portion, 6.1 mm pitch.

Groove portions: 21 g/$m^2$ weight, 1.8 mm thickness, 0.01 g/$cm^3$ fiber density, 1.4 mm width per groove portion, 6.1 mm pitch.

Percent open area between fibers: 69% measured from the convex portion side and 55% measured from the surface opposite of the surface where the convex portions protrude.

Open area per single unit area between fibers: 14,477 $\mu m^2$ per single unit area measured from the surface where the convex portions protrude and 1,919 $\mu m^2$ per single unit area measured from the surface opposite the surface where the convex portions protrude.

Shape: The convex portions and the groove portions are formed, and the reverse surface of the convex portions is substantially flat so as to come in contact with the lower side.

3.4. Example 4

Fiber Structure

The fiber structure is as similar to that described in Example 1.

Manufacture Condition

Air flow is jetted using the above-mentioned ejection unit 910 and ejection holes 913 at a temperature of 80° C. and an air volume of 1,800 L/min. The fiber webs of above-mentioned fiber structure are punched by needles placed zigzag at a pitch of 5 mm in a longitudinal direction and a pitch of 5 mm in the width direction at a rate of 200 times/min and a speed of 3 m/min along the longitudinal direction in order to make fibers half tangled. Afterward, air flow is jetted by the ejection unit 910 and ejection holes 913 at above-mentioned condition while evacuating almost the same or a slightly larger volume of hot air from beneath the breathable net.

Result

Convex portions: 45 g/$m^2$ fiber weight, 2.3 mm thickness, 0.02 g/$cm^3$ fiber density, 4.3 mm width per convex portion, 5.8 mm pitch.

Groove portions: 17 g/$m^2$ weight, 0.8 mm thickness, 0.02 g/$cm^3$ fiber density, 1.0 mm width per groove portion, 5.9 mm pitch.

Percent open area between fibers: 64% measured from the convex portion side and 47% measured from the surface opposite of the surface where the convex portions protrude.

Open area per single unit area between fibers: 8,199 $\mu m$ per single unit area measured from the surface where the convex portions protrude and 1,576 $\mu m^2$ per single unit area measured from the surface opposite the surface where the convex portions protrude.

Shape: The convex portions and the groove portions are formed sequentially so as to be extended along the longitudinal direction. Moreover, convex portions and the groove portions are formed so as to have tangled points partially oriented downward and in an alternate fashion in the width direction.

4. Examples of Application

For example, the nonwoven fabric of the present invention can be used as a surface sheet of absorbent products such as sanitary napkins, pantiliners and diapers. In this case, the convex portions may be the side which comes in contact with the skin or the reverse side, but making the convex portions the side which comes in contact with the skin, the contact area with the skin is reduced and it may be unlikely for the users to feel wet from the body fluid. In addition, the nonwoven fabric may be used as intermediate sheets between surface sheets and absorbers of the absorbent products. The contact area with the surface sheets or absorbers is reduced, thereby making the liquid unlikely to reverse its course from the absorbers. Furthermore, the nonwoven fabric may be used as side sheets of absorbent products, outermost of diapers, etc. and zip fastener materials, taking advantages of reduction in contact area with the skin or their cushion-like feel. The nonwoven fabric may also be used for various purposes such as wipers for removing dusts or dirt attached to the floor or body, masks and nursing milk pads, etc.

4.1. Surface Sheet of Absorbent Products

As an application of the nonwoven fabric of the present invention, the nonwoven fabric having convex portions and groove portions, and groove portions are of relatively low fiber density may be used as surface sheets 301 and 302 of the absorbent products as shown in FIGS. 19 and 20, for example. In this case, it is preferable to place the nonwoven fabric in a way so that the surface on which the convex portions are formed is the side which comes into contact with the skin.

When the nonwoven fabric is used as surface sheets 301 and 302 of absorbent products, discharged predefined liquid is mostly fed into the groove portions. The nonwoven fabric of the present invention has a low fiber density in the groove portions. That is to say, because the number of fibers per unit volume is less, the inhibitory elements of the liquid permeation become less, and the liquid can be rapidly transferred downward.

Furthermore, even if the fiber density of the groove portions is low, the surface sheets 301 and 302 can be protected from receiving damages caused by additional force such as friction in the width direction during use of absorbent products because most of the fibers in the groove portions are oriented in the width direction, and the tensile strength in the width direction is high.

In contrast, the convex portions have high fiber density. This is because the fibers are moved by the fluid, consisting mainly of gaseous matter, during forming of groove portions, and the sides of the convex portions are formed with the moved fibers. The rigidity of the sides of the convex portions is high because the fibers are closely packed. And because the center portions sandwiched between the sides of the convex portions contain a lot of fibers oriented in the thickness direction, the convex portions are unlikely to be crushed easily even with additional weight, and if the convex portions are crushed by weight, they exhibit high ability to recover from compression.

This makes it possible to maintain the contact area with the skin small even if the weight added to the surface sheets 301 and 302 changes due to changes in positions, thereby maintaining the tactile sensation. Furthermore, the liquid is unlikely to reattach to the skin broadly even if the liquid once absorbed by the absorber reverses its course.

4.2. Intermediate Sheets of Absorbent Products

As an application of the nonwoven fabric of the present invention, the nonwoven fabric having groove portions and convex portions, and groove portions of relatively low fiber density may be used as an intermediate sheet 311 of absorbent products as shown in FIG. 21, for example. In this case, it is preferable to place the nonwoven fabric in a way so that the surface on which the convex portions are formed is the surface sheet 310 side.

Multiple spaces are formed in between the surface sheet 310 and the intermediate sheet 311 by disposing the nonwoven fabric as the intermediate sheet 311 in a way so that the surface on which the convex portions are formed is the surface sheet 310 side. This prevents the liquid from spreading in the surface sheet 310 broadly because of less inhibitory elements of the liquid permeation even if a large volume of liquid is discharged in a short time.

Furthermore, even when the liquid once penetrated through the intermediate sheet 311 and absorbed by absorber reversed its course, the liquid is unlikely to return to the surface sheet 310 and reattach to the skin broadly because contact ratio between the intermediate sheet 311 and the surface sheet 310 is low.

Since the center portions of the convex portions in the intermediate sheet 311 contain large amount of fibers oriented in the thickness direction as compared to the side portions or groove portions, and the tops of the convex portions and the surface sheet 310 are in contact with each other, the residual liquid in the surface sheet 310 is likely to be drawn into the thickness direction. This makes the liquid unlikely to remain in the surface sheet 310.

It is possible to prevent the spreading of liquid and to suppress residual liquid through the surface sheet 310 as described above and to thereby inhibit broad attachment of the liquid to the skin for a long time. Furthermore, the content of the longitudinally oriented fibers oriented in the longitudinal direction in the side portions of the convex portions is high because the side portions are formed with fibers that have been shif ted to this region. This makes it possible for the liquid such as menstrual blood, etc. which is moved from the surface sheet 310 to the sides of the intermediate sheet 311 to be guided to the longitudinal direction. Therefore, preventing the leakage from absorbent products is possible even when the liquid is spread in the width direction to thereby improve absorption efficiency of absorbers.

4.3. Outermost of Absorbent Products

As an application of the nonwoven fabric of the present invention, the nonwoven fabric having groove portions and convex portions, and the groove portions are of relatively low fiber density may be used as outer surfaces (outermost 321) of absorbent products such as diapers, etc. as shown in FIG. 22, for example. In this case, it is preferable to place the nonwoven fabric in a way so that the surface on which the convex portions are formed is the outer side of the absorbent products.

Since the surface on which the convex portions are formed in the outermost 321 is disposed to be outer side of the absorbent products, tactile sensation felt mostly by hand, etc. is improved during use of the absorbent products. In addition, it excels in breathability because of low fiber density of the groove portions.

5. Structure Material

Each structure material will be described in detail below.

5.1. Nonwoven Fabric-Related 5.1.1. Fiber Aggregate

The fiber aggregates formed into substantially sheet-like form contain fibers that are mobile within the sheet configuring the fiber aggregates. Stated differently, they are fiber aggregates with fibers that are free from each other. The mobile fibers may be described as degree of freedom at which the fibers can be moved freely in the fiber webs that are the fiber aggregates, while being jetted by the fluid consisting mainly of gaseous matter. For example, the fiber aggregates may be formed by blowing out the mixed fibers in which multiple fibers are mixed to form fiber layers of predetermined thickness. In addition, each of the different fibers are blown out for multiple times to form fiber layers, for example.

Examples of the fiber aggregates of the present invention include fiber webs formed by card method or fiber webs with heat sealed fibers prior to solidification. Moreover, examples also include webs formed by air-laid method, or fiber webs with heat sealed fibers prior to solidification. In addition, fiber webs embossed by point bonding method with heat sealed fibers prior to solidification, fiber aggregates formed by spunbond method prior to embossing, or embossed fiber aggregates with heat sealed fibers prior to solidification may be included in examples. Furthermore, examples also include fiber webs formed by needle punching and half tangled, fiber webs formed by spunlace method and half tangled, fiber aggregates formed by melt blown method with heat sealed fibers prior to solidification, or fiber aggregates formed by solvent welding with fibers prior to solidification with solvent.

The favorable fiber webs in which fibers are easily rearranged by air (fluid) flow include fiber webs formed by card method using relatively long fibers, and webs formed only by tangling with fibers that are highly mobile prior to heat sealing. In addition, it is preferable to use through-air method in which thermoplastic fibers contained in fiber aggregates are heat sealed by heating by means of a specified heating apparatus, etc. in order to form nonwoven fabric after forming groove (irregular) portions, etc. by multiple air (fluid) flow while maintaining shapes thereof.

5.1.2. Fiber

Examples of fibers that forms the fiber aggregates (fibers 101 configuring the fiber webs 100 as shown in FIG. 1, for example) include fibers made of single or composite thermoplastic resins such as low-density polyethylene, high-density polyethylene, straight-chain polyethylene, polypropylene, polyethylene terephthalate, modified polypropylene, modified polyethylene terephthalate, nylon, polyamide, etc.

Examples of composite body of fibers include core-in-sheath type with melting point of core component being greater than the melting point of sheath component, biased core type of core-in-sheath structure, and side-by-side type in which right and left components have different melting points. Moreover, hollow type, flat, different types such as Y or C, three-dimensional crimped fibers by potential crimping or apparent crimping, and divided fibers divided by physical load such as water flow, heat or embossing may also be mixed in the above composite body of fibers.

Furthermore, predetermined crimped fibers by apparent crimping or potential crimping may be blended for forming 3-dimensional crimped shape. The 3-dimensional crimped shape may include substantially spiral shape, zigzag shape and Ω-like shape, and the fibers are partially oriented in the thickness direction even though most fibers are oriented in a substantially flat surface direction. This makes buckling strength of the fiber itself to work in the thickness direction, and the thickness is likely to be maintained without being crushed by additional external pressure. Furthermore, having a substantially spiral shape makes it easier to resume its original thickness after being freed from external pressure even if crushing occurs due to excessive external pressure because substantially spiral shape is likely to resume its original shape after being freed from external pressure.

The fiber formed by apparent crimping is a general term for fibers formed by mechanical crimping, biased core type of core-in-sheath structure and side-by-side types which have been crimped in advance. The fibers formed by potential crimping are the fibers crimped by heat.

Mechanical crimping is a process in which continuous and straight fibers after fiber forming are controlled by the difference in circumferential velocity of line speed, heat or pressure, and as the number of crimping per unit length increases, buckling strength under external pressure is increased. For example, the number of crimping is preferably in the range of 10 per inch to 35 per inch and more preferably in the range of 15 per inch to 30 per inch.

The fibers formed by heat contraction are fibers made of two or more resins of different melting points which are crimped three dimensionally by the change in heat contraction percentage, due to the difference in melting points, caused by heat. Examples of resin structure in the cross section of fibers include biased core type of core-in-sheath structure and side-by-side type with right and left components of different melting points. The heat contraction percentage of the above fibers is preferably in the range of 5% to 90% and more preferably in the range of 10% to 80%, for example.

The method for measuring heat contraction percentage is as follows. (1) A web of 200 g/m$^2$ containing 100% of fiber is formed for measurement, (2) a sample cut in a dimension of 250 mm×250 mm is prepared, (3) the sample is left unattended in an oven at 145° C. (418.15 K) for 5 minutes, (4) the length after contraction is measured, and (5) heat contraction percentage is then calculated from the difference in lengths before and after heat contraction.

When the nonwoven fabric is used as a surface sheet, fineness is preferably in the range of 1.1 dtex to 8.8 dtex in consideration of liquid intrusion or texture, for example.

When the nonwoven fabric is used as a surface sheet, hydrophilic, cellulosic fibers such as pulps, chemical pulps, rayons, acetates, natural cottons may be contained, for example, as fibers configuring the fiber aggregates for absorbing a small amount of menstrual blood or sweat that tend to remain on the skin. However, because cellulosic fibers are not likely to discharge the liquid once absorbed therein, the content is preferably in the range of 0.1% by weight to 5% by weight of whole sheet, for example.

When the nonwoven fabric is used as a surface sheet, hydrophilic agent or water-repellent agent may be kneaded into, or applied onto the hydrophobic synthesized fiber as mentioned above, for example, in consideration of liquid intrusion or rewet back. Or, hydrophilic property may be provided by corona or plasma treatment. Moreover, water-repellent fiber may also be contained. The water-repellent fiber in this case is the fiber treated with a known water-repellent treatment.

In addition, inorganic fillers such as titanic oxide, barium sulfate, calcium carbonate may be contained in the sheet for improved lightening. In the case of composite fiber of core-in-sheath type, the inorganic fillers may be contained only in the core or both in core and sheath.

As mentioned above, fibers may be rearranged easily by air flow in the fiber web formed by the card method in which relatively long fibers are used. When nonwoven fabric is formed after forming groove (irregular) portions, by multiple air flows while keeping the shapes thereof, through-air method in which thermoplastic fibers are heat sealed by heat is preferable. The fiber suitable for this method are fibers of core-in-sheath structure or side-by-side structure for heat sealing the cross points of fibers, and the fibers of core-in-sheath structure in which sheaths are likely to be heat sealed steadily are more preferable. Especially, using composite fiber of core-in-sheath structure made of polyethylene terephthalate and polyethylene or polypropylene and polyethylene is preferable. These fibers may be used alone or in combination. The length of fibers is preferably 20 mm to 100 mm and more preferably 35 mm to 65 mm.

5.2. Nonwoven Fabric Manufacturing Apparatus-Related 5.2.1. Fluid Consisting Mainly of Gaseous Matter Examples of the fluid, consisting mainly of gaseous matter, in the present invention include gaseous matters with temperatures adjusted to room temperature or predefined temperature or aerosols with gaseous matter containing particles of solid matter or liquid.

Examples of gaseous matter include air and nitrogen. In addition, gaseous matter contains vapor of liquid such as water vapor.

Aerosols are gaseous matters in which liquid or solid matter is dispersed, and examples are as follows. Examples include gaseous matters in which inks for coloring, softeners such as silicon for improving flexibility, hydrophilic or water-repellent activators for preventing charging or controlling moistness, inorganic fillers such as titanic oxide and barium sulfate for increasing the energy of fluid, powder bonds such as polyethylene for increasing the energy of fluid as well as improving the ability to maintain irregularities during heat treatment, antihistamines such as diphenhydramine hydrochloride and isopropyl methylphenol for antiitching, moisturizing agents or disinfection agents are dispersed. The solid matter includes gelatinous matter.

The temperature of the fluid, consisting mainly of gaseous matter, can be adjusted accordingly. Temperatures are adjusted according to the characteristic of the fibers configuring the fiber aggregates or shape of the nonwoven fabric being manufactured.

It is preferable for the temperature of the fluid, consisting mainly of gaseous matter, to be high in some measure because it improves the capability of moving the fibers configuring the fiber aggregates favorably. Moreover, when the thermoplastic fibers are contained in the fiber aggregates, the temperature of the fluid, consisting mainly of gaseous matter, is set at a temperature at which the thermoplastic fibers can be softened in order to soften or melt as well as to resolidify the thermoplastic fibers placed in the area to which the fluid, consisting mainly of gaseous matter, is jetted.

By setting the temperature as above, shapes of the nonwoven fabrics are maintained by jetting the fluid, consisting mainly of gaseous matter, for example. In addition, strength with which the fiber aggregates (nonwoven fabrics) are protected from scattering is provided during moving of the fiber aggregates by means of a predetermined conveying unit.

Flow volume of the fluid, consisting mainly of gaseous matter, can be adjusted accordingly. Specific examples of fiber aggregates in which fibers are freely movable include fiber aggregates with sheath made of high-density polyethylene and core made of polyethylene terephthalate, having core-in-sheath fiber with a fiber length of 20 mm to 100 mm or preferably 35 mm to 65 mm and a fineness of 1.1 dtex to 8.8 dtex or preferably 2.2 dtex to 5.6 dtex as a main constituent. If fiber spreading is performed by the card method, fibers with a fiber length of 20 mm to 100 mm or preferably 35 mm to 65 mm are used, and if it is performed by an air-laid method, fibers with a fiber length of 1 mm to 50 mm, preferably 3 mm to 20 mm are used to form fiber web 100 adjusted to be in the range of 10 g/m$^2$ to 1,000 g/m$^2$, preferably 15 g/m$^2$ to 100 g/m$^2$.

The exemplary jetting condition of the fluid, consisting mainly of gaseous matter, is as follow. Hot air at a temperature of 15° C. to 300° C. (288.15 K to 573.15 K) or preferably 100° C. to 200° C. (373.15 K to 473.15 K) is jetted with a volume of 3 L/min per hole to 50 L/min per hole or preferably 5 L/min per hole to 20 L/min per hole to the fiber web 100 from ejection unit 910 on which ejection holes 913, which are circle, ellipse or rectangle having a diameter of 0.1 mm to 30 mm, preferably 0.3 mm to 10 mm, a pitch of 0.5 mm to 20 mm, preferably 3 mm to 10 mm, are formed, as shown in FIG. 8 or 9.

For example, it is preferable for the fiber aggregate of the present invention to have fibers which can change positions or orientations thereof when the fluid, consisting mainly of gaseous matter, is jetted under in the above condition. The nonwoven fabrics as shown in FIGS. 2 and 3 can be formed under the above manufacturing condition by using the above fibers.

The dimensions and weights of the groove portions 1 and the convex portions 2 are as follows. The thickness of the groove portions 1 is in the range of 0.05 mm to 10 mm, preferably 0.1 mm to 5 mm, width is in the range of 0.1 mm to 30 mm, preferably 0.5 mm to 5 mm, weight is in the range of 2 g/m$^2$ to 900 g/m$^2$, or preferably 10 g/m$^2$ to 90 g/m$^2$. The thickness of the convex portions 2 is in the range of 0.1 mm to 15 mm, preferably 0.5 mm to 10 mm, width is in the range of 0.5 mm to 30 mm, preferably 1.0 mm to 10 mm, fiber weight is in the range of 5 g/m$^2$ to 1,000 g/m$^2$, preferably 10 g/m$^2$ to 100 g/m$^2$. The nonwoven fabric can be formed in the range of approximately the above numerical values; however, it is not limited to the above range.

5.2.2. Breathable Support Member

Examples of the breathable support member 200 include support members with the supporting side of the fiber web 100 is substantially flat or curved, and the flat surface or curved surface thereof is substantially flat. Examples of flat or curved shape include plate-like or cylindrical shape. Furthermore, being substantially flat means, for example, that irregularities are not formed on the surface of the support member on which the fiber web 100 is placed. Specific examples of the support member include the net which is the net-like support member 210 on which the irregularities are not formed.

Examples of the breathable support member 200 include a plate-like support member or a cylindrical support member. Specifically, examples include the abovementioned net-like support member 210 and the support member 270.

The breathable support member 200 can be placed onto the nonwoven fabric manufacturing apparatus 90 as a detachable unit. This allows the placement of a suitable breathable support member 200 according to the desired nonwoven fabric. Stated differently, the breathable support member 200 can be changed to another breathable support member selected from different breathable support members on the nonwoven fabric manufacturing apparatus 90.

The net-like support member 210 as shown in FIGS. 4A and 4B, the breathable net-like part in the support member 220 as shown in FIGS. 16A and 16B and the support member 270 as shown in FIG. 18 are explained below. Examples of the breathable net-like part include threads made of resins such as polyester, polyphenylene sulfide, nylon, conductive monofilament, etc., or threads made of metals such as stainless steel, copper and aluminum that are woven by flat weaving, twill weaving, sateen weaving, double weaving and spiral weaving, etc.

The ventilation rate of the breathable net can be modified, for example, by partially changing the weaving method, thread thickness or thread shape. Specifically, it may be exemplified by a spiral-woven breathable mesh of polyester and spiral-woven breathable mesh woven with stainless steel flat and circular threads.

Examples of a plate-like support member include sleeves made of metals such as stainless steel, copper and aluminum. For example, sleeves may be of the above metal plate from which a predefined pattern is partially cut out. The area from which the metal has been cut out becomes a breathable portion, and the area from which the metal has not been cut out becomes an impervious portion. Moreover, the surface of the impervious portion is preferably flat for improving smoothness of the surface.

Examples of sleeves include stainless steel sleeves having a thickness of 0.3 mm on which lateral rectangle holes with rounded corners having a length of 3 mm and a width of 40 mm formed by cutting metal out are disposed in lattice-like arrangement at intervals of 2 mm in the line flow direction (moving direction) and at intervals of 3 mm in the width direction.

Examples also include sleeves on which holes are disposed in a zigzag arrangement. For example, stainless steel sleeves F of 0.3 mm thickness on which circular holes having a diameter of 4 mm formed by cutting metal out are disposed at a pitch of 12 mm in the line flow direction (moving direction) and at a pitch of 6 mm in the width direction in a zigzag arrangement. As described above, cut out patterns (formed holes) and arrangements may be decided accordingly.

Furthermore, examples also include the net-like support member 260 with predefined roughness as shown in FIG. 12. For example, the breathable support member having areas where the fluid, consisting mainly of gaseous matter, is not jetted directly and alternate roughness (corrugated shape, for example) are formed in the line flow direction (moving direction) may be included. By using the net-like support member 260 as described above, it is possible to obtain a nonwoven fabric having predetermined openings as well as alternate roughness (corrugated shape, for example) extended in the whole nonwoven fabric.

5.2.3. Ejection Unit

Intervals between concave portions (groove portions) of the formed irregularities or heights of the convex portions can be adjusted accordingly, for example, by having an ejection unit 910 which can change the direction of the fluid consisting mainly of gaseous matter. Moreover, groove portions can be adjusted to have a corrugated, zigzag or other arrangement accordingly by making the direction of the above fluid automatically changeable. In addition, shapes or forming patterns of the groove portions or openings can be adjusted accordingly by adjusting the ejection volume or ejection time of the fluid consisting mainly of gaseous matter. Jetting angle of the fluid consisting mainly of gaseous matter may be vertical to the fiber web 100, at a predefined angle in the line flow direction, which is the moving direction F of the fiber web 100, or at a predefined angle in the reverse direction of the line flow direction.

5.2.4. Heating Unit

Examples of the method for bonding fibers 101 in the nonwoven fabric 170 on which predefined openings are formed include needle punching, spunlace method and solvent welding, or point bonding method or through-air method for heat bonding. Of these, through-air method is preferable for maintaining formed shape of predefined openings. And heat treatment by through-air method by means of the heater unit 950 is preferable, for example.

5.2.5. Others

The nonwoven fabric manufactured by heat by means of the heater unit 950 is conveyed to cutting step in which the nonwoven fabric is cut in a specified shape or to rewinding step by the conveyer 930 and the conveyer 940 running in a specified direction F. The conveyer 940 may contain a belt unit 949 and a rotating unit 941 as similar to the conveyer 930.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A nonwoven fabric having a first direction and a second direction, said nonwoven fabric comprising:

a plurality of jetted areas to which a fluid is jetted; and a plurality of nonjetted areas to which the fluid is not jetted, wherein the nonwoven fabric is formed by jetting the fluid, comprising mainly of gaseous matter, to a fiber aggregate, a fiber density of each of the jetted areas is less than a fiber density of each of the nonjetted areas, a weight of each of the jetted areas is less than a weight of each of the nonjetted areas, and in each of the jetted areas, the content of fibers oriented in the first direction is less than the content of fibers oriented in the second direction.

2. The nonwoven fabric according to claim 1, wherein a value of percent open area measured from a first surface side in the thickness direction of the nonwoven fabric is greater than a value of percent of open area measured from a second surface side which is opposite to the first surface side in each of the nonjetted areas.

3. The nonwoven fabric according to claim 1, wherein each of the jetted areas comprises a number of groove portions hollowed in the thickness direction of the nonwoven fabric on the first surface side of the nonwoven fabric, and each of the nonjetted areas is disposed along each of the groove portions and comprises a number of convex portions protruding in the thickness direction on a first surface side of the nonwoven fabric.

4. The nonwoven fabric according to claim 3, wherein each of the convex portions comprises side portions formed on both sides of the convex portions, and the fiber density of each of the side portions is greater than the fiber density of each of the groove portions.

5. The nonwoven fabric according to claim 4, wherein the fiber density of each of the side portions is greater than the fiber density of the center portions that are sandwiched between the side portions of each of the convex portions.

6. A nonwoven fabric having a first direction and a second direction, said nonwoven fabric comprising:

a plurality of jetted areas to which a fluid is jetted; and a plurality of nonjetted areas to which the fluid is not jetted, wherein the nonwoven fabric is formed by jetting the fluid, comprising mainly of gaseous matter, to a fiber aggregate, a fiber density of each of the jetted areas is less than a fiber density of each of the nonjetted areas, a weight of each of the jetted areas is less than a weight of each of the nonjetted areas, each of the jetted areas comprises a number of groove portions hollowed in the thickness direction of the nonwoven fabric on the first surface side of the nonwoven fabric, each of the nonjetted areas is disposed along each of the groove portions and comprises a number of convex portions protruding in the thickness direction on a first surface side of the nonwoven fabric, and a difference between the value of the percent open area measured from the first surface side and the value of the percent open area measured from the second surface side is no less than 5% in each of the convex portions.

7. A nonwoven fabric having a first direction and a second direction, said nonwoven fabric comprising:

a plurality of jetted areas to which a fluid is jetted; and a plurality of nonjetted areas to which the fluid is not jetted, wherein the nonwoven fabric is formed by jetting the fluid, comprising mainly of gaseous matter, to a fiber aggregate, a fiber density of each of the jetted areas is less than a fiber density of each of the nonjetted areas, a weight of each of the jetted areas is less than a weight of each of the nonjetted areas, each of the jetted areas comprises a number of groove portions hollowed in the thickness direction of the nonwoven fabric on the first surface side of the nonwoven fabric, each of the nonjetted areas is disposed along each of the groove portions and comprises a number of convex portions protruding in the thickness direction on a first surface side of the nonwoven fabric, the fiber density of each of the groove portions is no greater than 0.18 g/cm$^3$, and the fiber density of each of the convex portions is no greater than 0.20 g/cm$^3$.

8. The nonwoven fabric according to claim 3, wherein each of the groove portions comprises a number of sparse areas where the fiber density is less than an average fiber density of a bottom portion formed at a bottom of the groove portions.

9. The nonwoven fabric according to claim 8, wherein the sparse areas are openings.

10. The nonwoven fabric according to claim 9, wherein the fiber density of a peripheral border of each of the openings is greater than the fiber density of the area sandwiched between the openings in the groove portions.

11. The nonwoven fabric according to claim 9, wherein the fibers in the peripheral border of each of the openings is oriented along the peripheral border of each of the openings.

12. The nonwoven fabric according to claim 3, wherein one convex portion differs in height in the thickness direction from the other convex portions which lie adjacent to the said convex portion across one of the groove portions in the thickness direction.

13. The nonwoven fabric according to claim 3, wherein each of the convex portions is substantially flat on the first surface side of the nonwoven fabric.

14. The nonwoven fabric according to claim 3, wherein a number of areas protruding in the direction opposite to the direction in which the convex portions protrude are formed on a second surface side which is opposite to the first surface side in each of the nonjetted areas.

15. The nonwoven fabric according to claim 3, wherein the nonwoven fabric is substantially corrugated in the first direction.

16. The nonwoven fabric according to claim 2, wherein the second surface side of the nonwoven fabric is a substantially planar surface.

17. The nonwoven fabric according to claim 1, wherein the fiber aggregate comprises water-repellent fiber.

18. The nonwoven fabric according to claim 1, wherein the first direction defines a longitudinal direction in which the jetted areas extend, and the second direction defines a width direction substantially orthogonal to the longitudinal direction.

19. The nonwoven fabric according to claim 6, wherein said gaseous matter comprises air.

20. The nonwoven fabric according to claim 6, wherein said gaseous matter comprises nitrogen.

21. The nonwoven fabric according to claim 7, wherein said gaseous matter comprises air.

22. The nonwoven fabric according to claim 7, wherein said gaseous matter comprises nitrogen.

23. The nonwoven fabric according to claim 1, wherein said fluid is at a temperature of 15° C. to 300° C.

24. The nonwoven fabric according to claim 1, wherein said fluid is at a temperature of 100° C. to 200° C.

* * * * *